US008190040B2

(12) United States Patent
Mimura

(10) Patent No.: US 8,190,040 B2
(45) Date of Patent: May 29, 2012

(54) DEVELOPING CARTRIDGE INCLUDING SHUTTER MAINTAINED IN A CLOSED STATE BY AN ELECTRICALLY-RELEASING ADHESIVE AND IMAGE FORMING APPARATUS USING THE SAME

(75) Inventor: Shinya Mimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 395 days.

(21) Appl. No.: 12/573,931

(22) Filed: Oct. 6, 2009

(65) Prior Publication Data

US 2010/0092196 A1 Apr. 15, 2010

(30) Foreign Application Priority Data

Oct. 10, 2008 (JP) ..... 2008-264026
Apr. 9, 2009 (JP) ..... 2009-094858

(51) Int. Cl.
*G03G 15/00* (2006.01)
*G03G 15/08* (2006.01)

(52) U.S. Cl. ..... 399/12; 399/260

(58) Field of Classification Search ..... 399/12, 399/258, 260
See application file for complete search history.

(56) References Cited

U.S. PATENT DOCUMENTS 7,332,218 B1 2/2008 Gilbert
7,738,818 B2 * 6/2010 Murakami et al. ..... 399/258

FOREIGN PATENT DOCUMENTS

JP 05-249777 9/1993
JP 06-083194 3/1994

* cited by examiner

*Primary Examiner* — William J Royer
(74) *Attorney, Agent, or Firm* — Renner, Otto, Boisselle & Sklar, LLP

(57) ABSTRACT

A developing cartridge includes: a developing roller for developing an electrostatic latent image on a photoconductor with a toner; and a developing tank for storing the toner to be supplied to the developing roller, the developing tank including: a toner receiving port for receiving the toner to be stored; a shutter having a function for sliding to open and close the toner receiving port, the shutter being adapted to be maintained in a closed state by an electrically-releasing adhesive; and a pair of conductive member for supplying an electric current to the electrically-releasing adhesive to open the shutter.

10 Claims, 20 Drawing Sheets

DEVELOPING CARTRIDGE INCLUDING SHUTTER MAINTAINED IN A CLOSED STATE BY AN ELECTRICALLY-RELEASING ADHESIVE AND IMAGE FORMING APPARATUS USING THE SAME

CROSS-REFERENCE TO RELATED APPLICATIONS

This application is related to Japanese Patent Applications Nos. 2008-264026 filed on Oct. 10, 2008 and 2009-094858 filed on Apr. 9, 2009, whose priorities are claimed under 35 USC §119, and the disclosures of which are incorporated by reference in their entirety.

BACKGROUND OF THE INVENTION

1. Field of the Invention

The present invention relates to a developing cartridge and an image forming apparatus using the same.

2. Description of the Related Art

As for conventional image forming apparatuses such as copying machines and laser printers which employ electrophotographic systems, it has been a trend that toner cartridges or developing cartridges can be replaced by users themselves for improvement of convenience for the users. While such cartridges are usually replaced when the toner runs out, many cartridges are to be replaced when the cumulative number of printed sheets or the cumulative time of use reaches a predetermined level, because image quality is reduced as developers, components, or the like deteriorate.

For example, such a cartridge is provided with a fuse and a counter that records usage of the cartridge. The fuse is fused to reset the counter when the cartridge is initially mounted on an image forming apparatus (hereinafter, may be also referred to as initial detection). The counter instructs a user to replace the cartridge when the cartridge reaches time for replacement (see, for example, Japanese Unexamined Patent Publication No. HEI 5(1993)-249777).

A sealing member is usually used for the cartridge to prevent the toner or developer from leaking from the opening of the cartridge due to vibration during transportation of the cartridge. However, some users carelessly mount such a cartridge on the image forming apparatus without removing the sealing member, which causes a malfunction to the cartridge, the developing cartridge, or the image forming apparatus.

SUMMARY OF THE INVENTION

In view of the above-described circumstances, the present invention provides a developing cartridge capable of preventing such a malfunction caused when the cartridge is mounted on an image forming apparatus, and an image forming apparatus using the cartridge.

The present invention provides a developing cartridge and an image forming apparatus using the same, the cartridge including: a developing roller for developing an electrostatic latent image on a photoconductor with a toner; and a developing tank for storing the toner to be supplied to the developing roller, the developing tank including: a toner receiving port for receiving the toner to be stored; a shutter having a function for sliding to open and close the toner receiving port, the shutter being adapted to be maintained in a closed state by an electrically-releasing adhesive and a pair of conductive members for supplying an electric current to the electrically-releasing adhesive to open the shutter.

According to the present invention, the leakage of developer can be prevented against vibration during transportation, because the shutter is maintained in a closed state by the electrically-releasing adhesive. Also, malfunctions caused by mounting the developing cartridge on an image forming apparatus without removing a sealing member of the developing cartridge can be prevented, because the shutter can be used instead of the sealing member and opened by supplying an electric current to the electrically-releasing adhesive when the cartridge is mounted.

DESCRIPTION OF THE PREFERRED EMBODIMENTS

Figure 1:
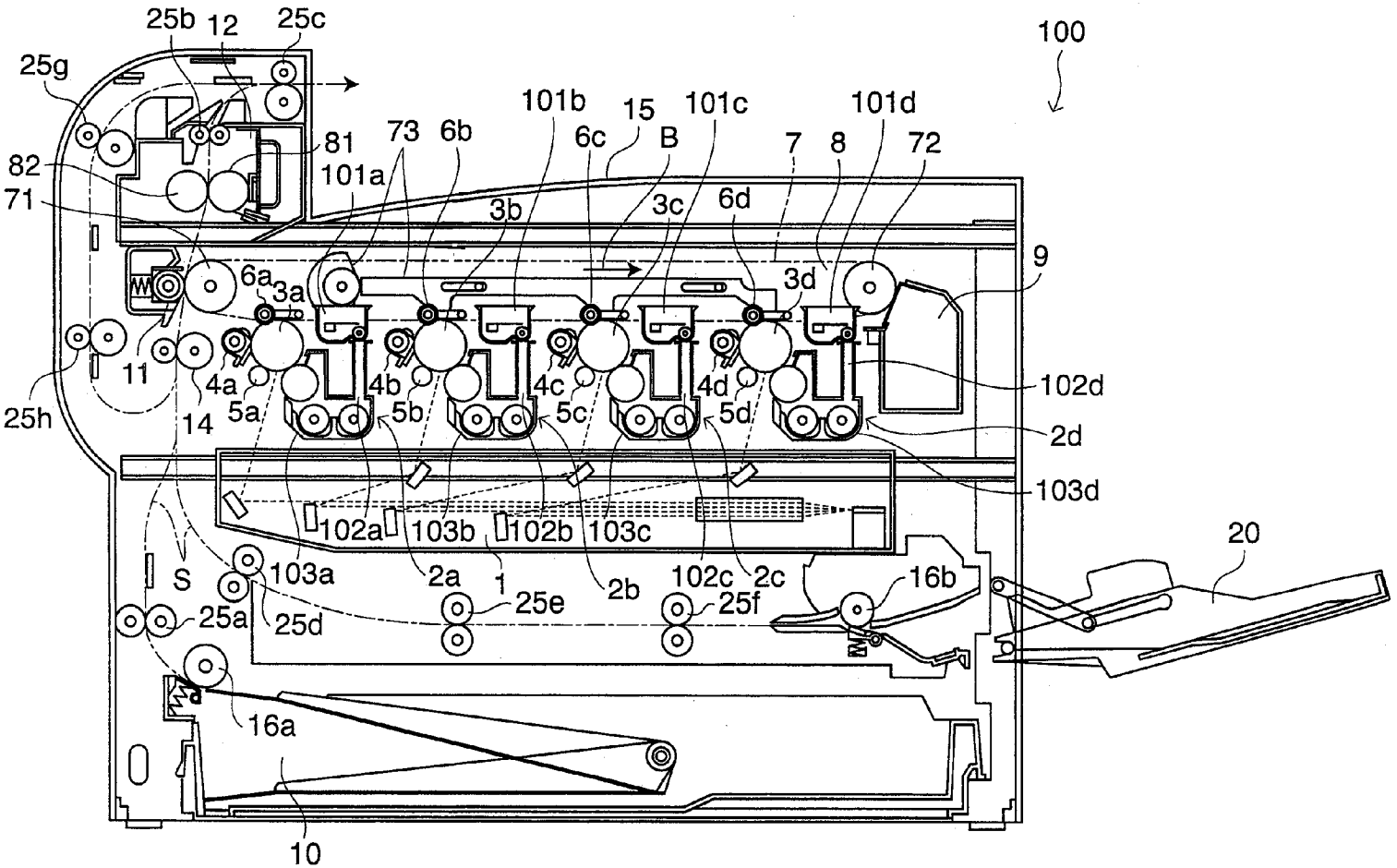
FIG. 1 is an explanatory diagram illustrating a configuration of an image forming apparatus according to Embodiment 1 of the present invention.

A developing cartridge according to the present invention includes: a developing roller for developing an electrostatic latent image on a photoconductor with a toner; and a developing tank for storing the toner to be supplied to the developing roller, the developing tank including: a toner receiving port for receiving the toner to be stored; a shutter having a function for sliding to open and close the toner receiving port, the shutter being adapted to be maintained in a closed state by an electrically-releasing adhesive; and a pair of conductive members for supplying an electric current to the electrically-releasing adhesive to open the shutter.

Here, the electrically-releasing adhesive refers to an adhesive that contains a composition whose bond can be electrochemically released and that decreases in its adhesive force in a composition face (interface) joining to an adhesion object in consequence of a bond-releasing reaction caused by an electric current applied thereto. A marketed product can be used for the electrically-releasing adhesive.

The developing tank may comprise a toner supplying device that is connected via the toner supplying port. The toner supplying device usable here may comprise a container for the toner being supplied and a conveyance means for conveying the toner from the container to the toner supplying port, for example.

It is preferable that the toner supplying device further comprises a biasing member for giving a biasing force in a direction of opening the shutter and the electrically-releasing adhesive maintains the shutter in a closed state by resisting the biasing force.

The pair of conductive members may consist of a first conductive member and a second conductive member. The shutter may have conductivity and form the first conductive member. The second conductive member may be provided in the developing tank so as to be opposed to the first conductive member. The electrically-releasing adhesive may exist between the first and second conductive members to maintain the shutter in a closed state when the shutter is closed.

In accordance with another aspect, the present invention provides an image forming apparatus using the above-described developing cartridge, the image forming apparatus comprising a power source section for opening the shutter by sending an electric current to the electrically-releasing adhesive via the pair of conductive members.

The image forming apparatus may further comprise a detection section for detecting an electrical resistance generated between the pair of conductive members.

Hereinafter, the present invention will be described in detail with reference to Embodiments 1 and 2 illustrated in the drawings.

Embodiment 1

FIG. 1 is an explanatory diagram illustrating an internal configuration of an image forming apparatus 100 according to Embodiment 1 of the present invention.

The image forming apparatus 100 is a printer of an electrophotographic system, and it forms a multicolor or monochrome image on a predetermined sheet (recording paper, recording medium) according to image data transmitted from an external device. Here, a scanner or the like may be provided in an upper part of the image forming apparatus 100.

In the image forming apparatus 100, image data of black (K), cyan (C), magenta (M), and yellow (Y) color components are handled individually, and a black image, a cyan image, a magenta image, and a yellow image are formed and the images of each color component are superimposed to form a color image. Therefore, developing devices 2*a*, 2*b*, 2*c*, 2*d*, photosensitive drums 3*a*, 3*b*, 3*c*, 3*d*, chargers 5*a*, 5*b*, 5*c*, 5*d*, and cleaner units 4*a*, 4*b*, 4*c*, 4*d* are provided in the image forming apparatus 100 as illustrated in FIG. 1 so that images of each color component can be formed. In other words, there are provided four image formation stations (image formation sections) each including one developing device, one photosensitive drum, one charger, and one cleaner unit.

Here, a to d of the reference numerals 2*a* to 2*d*, 3*a* to 3*d*, 4*a* to 4*d*, 5*a* to 5*d*, and the like are to indicate that members with a are for formation of black images, members with b are for formation of cyan images, members with c are for formation of magenta images, and members with d are for formation of yellow images. In addition, the image forming apparatus 100 is provided with an exposure unit 1, a fixing unit 12, a sheet transportation path S, a sheet feeding tray 10, and a sheet exit tray 15.

The chargers 5*a* to 5*d* are to uniformly charge surfaces of the photosensitive drums 3*a* to 3*d* at a predetermined potential. As the chargers 5*a* to 5*d*, a brush-type charger of a contact type or a charger-type charger of a non-contact type may be used other than a roller-type charger of a contact-type illustrated in FIG. 1.

The exposure unit 1 is a laser scanning unit (LSU) comprising a laser irradiation section and a reflection mirror as illustrated in FIG. 1. Other than the laser scanning unit, an EL or LED writing head in which light emitting elements are arranged in an array may be used. The exposure unit 1 exposes the charged photosensitive drums 3*a* to 3*d* according to inputted image data to form an electrostatic latent image according to the image data on the surfaces of the photosensitive drums 3*a* to 3*d*.

The developing devices 2*a* to 2*d* make visible (develop) the electrostatic latent images formed on the photosensitive drums 3*a* to 3*d* with toners of colors K, C, M, and Y, respectively. The developing devices 2*a*, 2*b*, 2*c*, 2*d* comprise toner hoppers 101*a*, 101*b*, 101*c*, 101*d*, toner transport mechanisms 102*a*, 102*b*, 102*c*, 102*d*, and developing cartridges 103*a*, 103*b*, 103*c*, 103*d*.

The developing cartridges 103*a* to 103*d* are removably loaded in the developing devices 2*a* to 2*d*, respectively. The toner hoppers 101*a* to 101*d* are disposed at upper positions in relation to the developing cartridges 103*a* to 103*d* and store unused toners to be supplied. The toners are supplied from the toner hoppers 101*a* to 103*d* to the developing cartridges 103*a* to 103*d* via the toner transport mechanisms 102*a* to 102*d*.

The cleaner units 4*a* to 4*d* remove and collect toners remaining on the surfaces of the photosensitive drums 3*a* to 3*d* after development and image transfer steps.

An intermediate transfer belt unit 8 is disposed above the photosensitive drums 3*a* to 3*d*. The intermediate transfer belt unit 8 comprises intermediate transfer rollers 6*a*, 6*b*, 6*c*, 6*d*, an intermediate transfer belt 7, an intermediate transfer belt driving roller 71, an intermediate transfer belt driven roller 72, an intermediate transfer belt tension mechanism 73, and an intermediate transfer belt cleaning unit 9.

The intermediate transfer rollers 6*a* to 6*d*, the intermediate transfer belt driving roller 71, the intermediate transfer belt driven roller 72, and the intermediate transfer belt tension mechanism 73 stretch the intermediate transfer belt 7 and rotationally drive the intermediate transfer belt 7 in an arrow B direction in FIG. 1.

The intermediate transfer rollers 6*a* to 6*d* are rotatably supported on a part to which the intermediate transfer rollers 6*a* to 6*d* are attached in the intermediate transfer belt tension mechanism 73 of the intermediate transfer belt unit 8. A transfer bias is given to the intermediate transfer rollers 6*a* to 6*d* for transferring the toner images on the photosensitive drums 3*a* to 3*d* onto the intermediate transfer belt 7.

The intermediate transfer belt 7 is provided so as to contact with each of the photosensitive drums 3*a* to 3*d*. A color toner image (multicolor toner image) is formed on the intermediate transfer belt 7 by sequentially superimposing and transferring the toner images of each color component formed on the photosensitive drums 3*a* to 3*d*. The intermediate transfer belt 7 is formed into an endless shape by using a film having a thickness of approximately 100 μm to 150 μm, for example.

Transfer of the toner images from the photosensitive drums 3*a* to 3*d* to the intermediate transfer belt 7 is performed by the intermediate transfer rollers 6*a* to 6*d* contacting with the reverse face of the intermediate transfer belt 7. A transfer bias of a high voltage (high voltage of a polarity (+) opposite to the charge polarity of the toner (−)) is applied to the intermediate transfer rollers 6*a* to 6*d* to transfer the toner images.

The intermediate transfer rollers 6*a* to 6*d* are formed of a metallic material (for example, stainless) with an axis having a diameter of, for example, 8 mm to 10 mm as a base, and the surface thereof is coated with a conductive elastomer (for example, EPDM, foamed urethane, and the like). The conductive elastomer allows the intermediate transfer rollers 6*a* to 6*d* to uniformly apply the high voltage to the intermediate transfer belt 7. Though a roller type is adopted in this embodiment, a brush can be used instead.

As described above, the electrostatic latent images on the photosensitive drums 3*a* to 3*d* are made visible to be toner images by toners of each color component individually, and the toner images are superimposed and layered on the intermediate transfer belt 7. Thus, the layered toner images are moved to a position where the intermediate transfer belt 7 contacts with a paper sheet that has been conveyed by rotation of the intermediate transfer belt 7 (transfer section) to be transferred on the paper sheet by a transfer roller 11 disposed in this position.

In this case, the intermediate transfer belt 7 and the transfer roller 11 are in contact, pressed against each other with a predetermined nip, and a voltage is applied to the transfer roller 11 to transfer the toner images to the paper sheet. This voltage is a high voltage of a polarity (+) opposite to the charge polarity of the toner (−).

In order to obtain the nip constantly, either one of the transfer roller 11 or the intermediate transfer belt driving roller 71 is formed of a rigid material such as a metal and the other is formed of a flexible material such as an elastic roller (elastic rubber roller, foamable resin roller, or the like).

Toners that have attached to the intermediate transfer belt 7 as a result of the contact between the intermediate transfer belt 7 and the photosensitive drums 3*a* to 3*d*, and toners that have remained on the intermediate transfer belt 7 without having been transferred during the transfer of the toner images from the intermediate transfer belt 7 to the paper sheet will be a cause for occurrence of color mixture of toners in a following step. Therefore, such toners are removed and collected by the intermediate transfer belt cleaning unit 9.

The intermediate transfer belt cleaning unit 9 is provided with a cleaning blade that contacts with the intermediate transfer belt 7. A part of the intermediate transfer belt 7 where it contacts with the cleaning blade is supported by the intermediate transfer belt driven roller 72 from its backside.

The sheet feeding tray 10 is for accumulating sheets (for example, recording paper) to be used for image formation, and it is provided below the image formation sections and the exposure unit 1. On the other hand, the sheet exit tray 15 provided in an upper part of the image forming apparatus 100 is for mounting a sheet after printing face-down.

In addition, the image forming apparatus 100 is provided with the sheet transportation path S for guiding a sheet in the sheet feeding tray 10 and a manual sheet feeding tray 20 to the sheet exit tray 15 via the transfer section and the fixing unit 12. The transfer section is located between the intermediate transfer belt driving roller 71 and the transfer roller 11.

In the sheet transportation path S, furthermore, there are arranged pickup rollers 16*a*, 16*b*, a registration roller 14, the transfer section, the fixing unit 12, conveyance rollers 25*a* to 25*h*, and the like.

The conveyance rollers 25*a* to 25*h* are small-sized rollers for facilitating and aiding conveyance of sheets, and they are provided along the sheet transportation path S. The pickup roller 16*a* is provided at an edge of the sheet feeding tray 10 and works as a lead-in roller for feeding sheets from the sheet feeding tray 10 to the sheet transportation path S one by one.

The pickup roller 16*b* is provided in the vicinity of the manual sheet feeding tray 20 and works as a lead-in roller for feeding sheets from the manual sheet feeding tray 20 to the sheet transportation path S one by one. The registration roller 14 is to temporarily hold a sheet being conveyed through the sheet transportation path S to convey the sheet to the transfer section when a front end of the toner images on the intermediate transfer belt 7 and a front end of the sheet are brought to the same position.

The fixing unit 12 comprises a heating roller 81, a pressure roller 82, and the like, and the heating roller 81 and the pressure roller 82 rotate while sandwiching a sheet therebetween. The heating roller 81 is controlled so as to be a predetermined fixing temperature. The heating roller 81 works with the pressure roller 82 to thermally press a sheet, thereby fusing, mixing, and bringing into pressed contact the toner images of each color transferred on the sheet and thermally fixing the images to the sheet. The sheet on which a multicolor toner image (toner images of each color) is fixed is conveyed to a reverse sheet delivery path in the sheet transportation path S by the conveyance rollers 25*a* to 25*h* and ejected onto the sheet exit tray 15 while being reversed (with the multicolor toner image facing down).

Next, a sheet conveying operation by the sheet transportation path S will be described. As described above, the sheet feeding tray 10 for previously containing sheets and the manual sheet feeding tray 20 to be used in the case of printing of a small quantity of sheets are arranged in the image forming apparatus 100. Each of the trays is provided with the pickup roller 16*a*, 16*b*, and these pickup rollers 16*a*, 16*b* feed sheets to the sheet transportation path S one by one.

In the case of one-sided printing, the sheet conveyed from the sheet feeding tray 10 is conveyed up to the registration roller 14 by the conveyance roller 25*a* in the sheet transportation path S, and then conveyed to the transfer section by the registration roller 14 when a front end of the sheet and a front end of the toner images layered on the intermediate transfer belt 7 are brought to the same position.

In the transfer section, the toner images are transferred onto the sheet, and the toner images are fixed on the sheet in the fixing unit 12. Thereafter, the sheet goes through the conveyance roller 25*b* and is ejected from the conveyance roller 25*c* to the sheet exit tray 15. The sheet conveyed from the manual sheet feeding tray 20 is conveyed up to the registration roller 14 by the conveyance rollers 25*f*, 25*e*, 25*d*. After that, the sheet is ejected to the sheet exit tray 15 through the same course as for the sheet fed from the sheet feeding tray 10.

In the case of double-sided printing, the sheet that has been finished with one-sided printing and gone through the fixing unit 12 as described above is chucked at a rear end thereof by the conveyance roller 25*c*. Next, the sheet is guided to the conveyance rollers 25*g*, 25*h* by reverse rotation of the conveyance roller 25*c*, goes through the registration roller 14, is finished with back-side printing, and then is ejected to the sheet exit tray 15.

Figure 2:
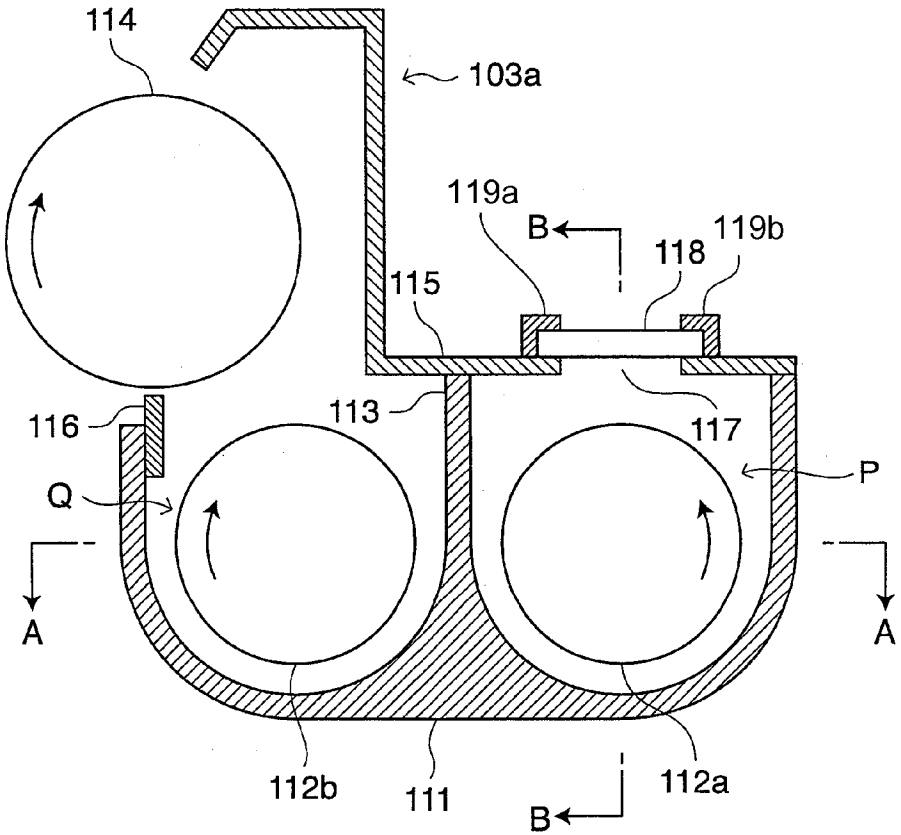
FIG. 2 is a sectional view of a developing cartridge according to Embodiment 1 of the present invention.
Figure 3:
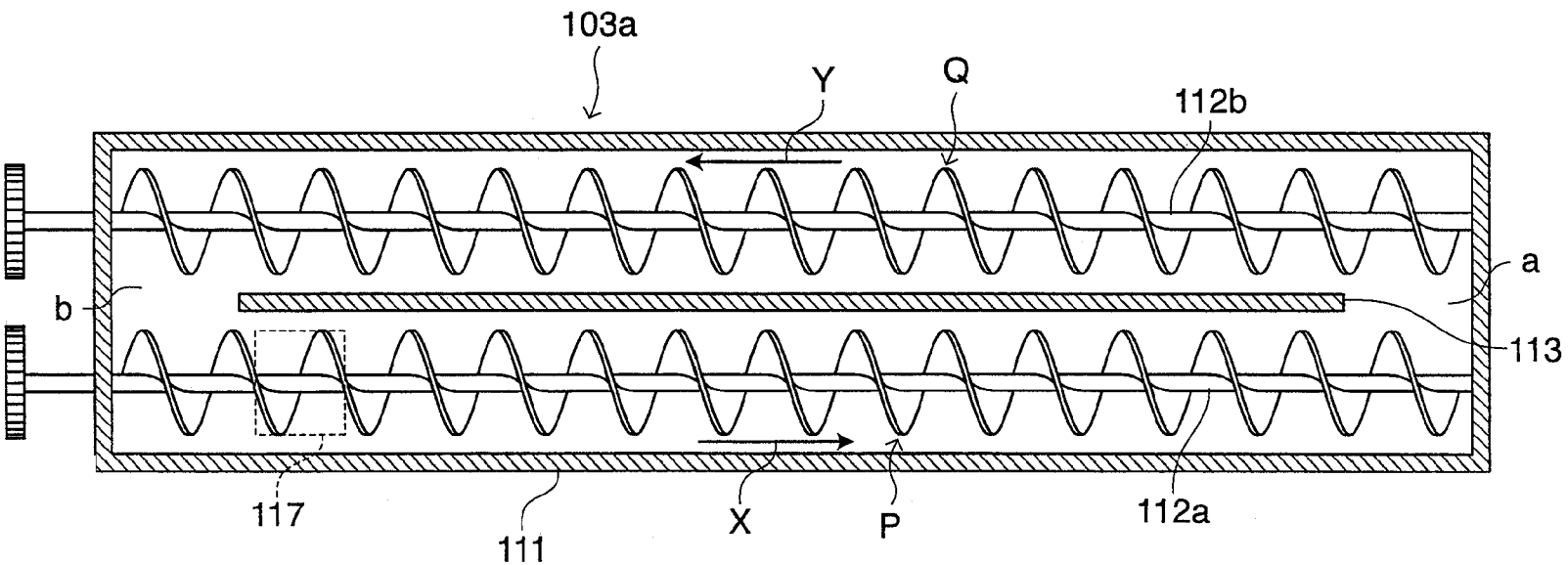
FIG. 3 is a sectional view as seen from an arrow direction A-A in FIG. 2.

Next, the developing cartridges 103*a* to 103*d* to be removably loaded in the developing devices 2*a* to 2*d* of the image forming apparatus 100 will be described. Here, since the developing cartridges 103*a* to 103*d* have the same configuration, the developing cartridge 103*a* will be described as their representative. FIG. 2 is a sectional view of the developing cartridge 103*a*; FIG. 3 is a sectional view as seen from an arrow direction A-A in FIG. 2; and FIG. 4 is a sectional view as seen from an arrow direction B-B in FIG. 2.

As illustrated in these drawings, the developing cartridge 103*a* is a device that has a developing roller 114 disposed so as to be opposed to the photosensitive drum 3*a*, and it supplies a toner onto the surface of the photosensitive drum 3*a* with the use of the developing roller 114 to make visible (develop into a toner image) an electrostatic latent image formed on the surface of the photosensitive drum 3*a*.

As illustrated in FIG. 2, the developing cartridge 103*a* comprises a developing tank 111, a developing tank cover 115, a toner supplying port 117, a shutter plate 118, guide members 119*a*, 119*b* (FIG. 5), a doctor blade 116, a first conveyance member 112*a*, a second conveyance member 112*b*, a separation plate 113, and an elastic member (pull spring) 105 (FIG. 4) in addition to the developing roller 114.

Figure 4:
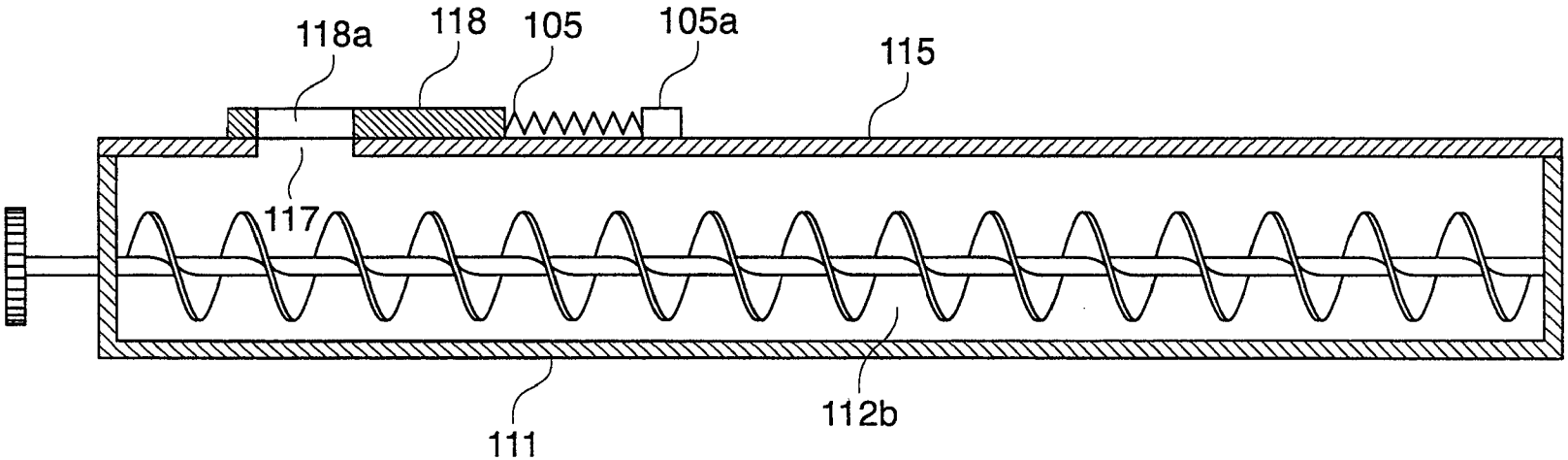
FIG. 4 is a sectional view as seen from an arrow direction B-B in FIG. 2.

As illustrated in FIG. 4, the shutter plate 118 has a shutter aperture 118*a*, and it is slidably provided on the developing tank cover 115 and biased by the elastic member (pull spring) 105 provided between the shutter plate 118 and an elastic member supporting part 105*a*.

Before or immediately after the developing cartridge 103*a* is loaded in the image forming apparatus 100, the shutter plate 118 is fixed at a position to close the toner supplying port 117 by an electrically-releasing adhesive as will be described later, and when the electrically-releasing adhesive is released by the action of electricity, the shutter plate 118 slides by receiving a biasing force of the elastic member 105 whose one end is supported by the supporting part 105*a*, thereby opening the toner supplying port 117.

The developing tank 111 illustrated in FIG. 2 comprises a tank for containing a developer including a toner and a carrier. The carrier of this embodiment is a magnetic carrier having magnetism.

The developing roller 114 is a magnet roller that rotates, and it is to draw the developer in the developing tank 111 to bear it on a surface thereof and supply the toner included in the developer borne on the surface thereof to the photosensitive drum 3*a*.

In addition, the developing tank cover 115 is detachably provided at an upper side of the developing tank 111. The toner supplying port 117 for supplying an unused toner to the developing tank 111 is formed in the developing tank cover 115.

The toner in the toner hopper 101*a* illustrated in FIG. 1 is transferred to the developing tank 111 through the toner transport mechanism 102*a* and the toner supplying port 117, thereby supplying the toner to the developing tank 111.

Furthermore, as illustrated in FIG. 2, FIG. 3, and FIG. 4, the first conveyance member 112*a* and the second conveyance member 112*b* are screw augers each comprising an axis and a spiral conveyance blade for stirring and conveying the developer in the developing tank 111, and the axis is rotationally driven by a driving means (not shown) such as a motor provided to the image forming apparatus 100, thereby stirring and conveying the developer.

As illustrated in FIG. 3, the first conveyance member 112*a* and the second conveyance member 112*b* are arranged so that they are opposed to each other having the separation plate 113 therebetween and so that their axes are in parallel, and set to rotate in directions opposite to each other. And, the first conveyance member 112*a* is set to convey the developer to an X direction illustrated in FIG. 3, and the second conveyance member 112*b* is set to convey the developer to a Y direction that is opposite to the X direction.

The inside of the developing tank 111 is sectioned into a first conveyance path P and a second conveyance path Q by the separation plate 113 provided between the first conveyance member 112*a* and the second conveyance member 112*b*.

In the developing tank 111, as illustrated in FIG. 3, a first communication path a and a second communication path b for communicating the first conveyance path P and the second conveyance path Q are formed in the vicinity of the both ends of each axial direction of the first conveyance member 112*a* and the second conveyance member 112*b*.

In addition, in this embodiment, the toner supplying port 117 is located in an area in the first conveyance path P and formed at a position shifted in the X direction in relation to the second communication path b as illustrated in FIG. 3. In other words, in the first conveyance path P, the toner is supplied to a downstream side of the second communication path b. In the developing tank 111, the first conveyance member 112*a* and the second conveyance member 112*b* convey the developer as described above. Specifically, in the first conveyance path P, the developer is conveyed in the X direction while being stirred by the first conveyance member 112*a* and arrives at the first communication path a.

The developer that has arrived at the first communication path a is conveyed to the second conveyance path Q after going through the first communication path a. In the second conveyance path Q, the developer is conveyed in the Y direction while being stirred by the second conveyance member 112*b* and arrives at the second communication path b. The developer that has arrived at the second communication path b is conveyed to the first conveyance path P after going through the second communication path b. In other words, the first conveyance member 112*a* and the second conveyance member 112*b* convey the developer while stirring the developer in directions opposite to each other.

Thus, the developer will move in a circulating manner in the developing tank 111, going through the first conveyance path P, the first communication path a, the second conveyance path Q, and the second communication path b in this order. Then, the developer is borne on the surface of the developing roller 114 to be drawn by rotation of the developing roller 114, while being conveyed through the second conveyance path Q, and the toner in the drawn developer moves to the photosensitive drum 3*a* to be used in turn.

Thus, the unused toner is supplied from the toner supplying port 117 to the first conveyance path P in order to make up for the used toner. The supplied toner is stirred and mixed with the previously existing developer in the first conveyance path P.

Figure 5:
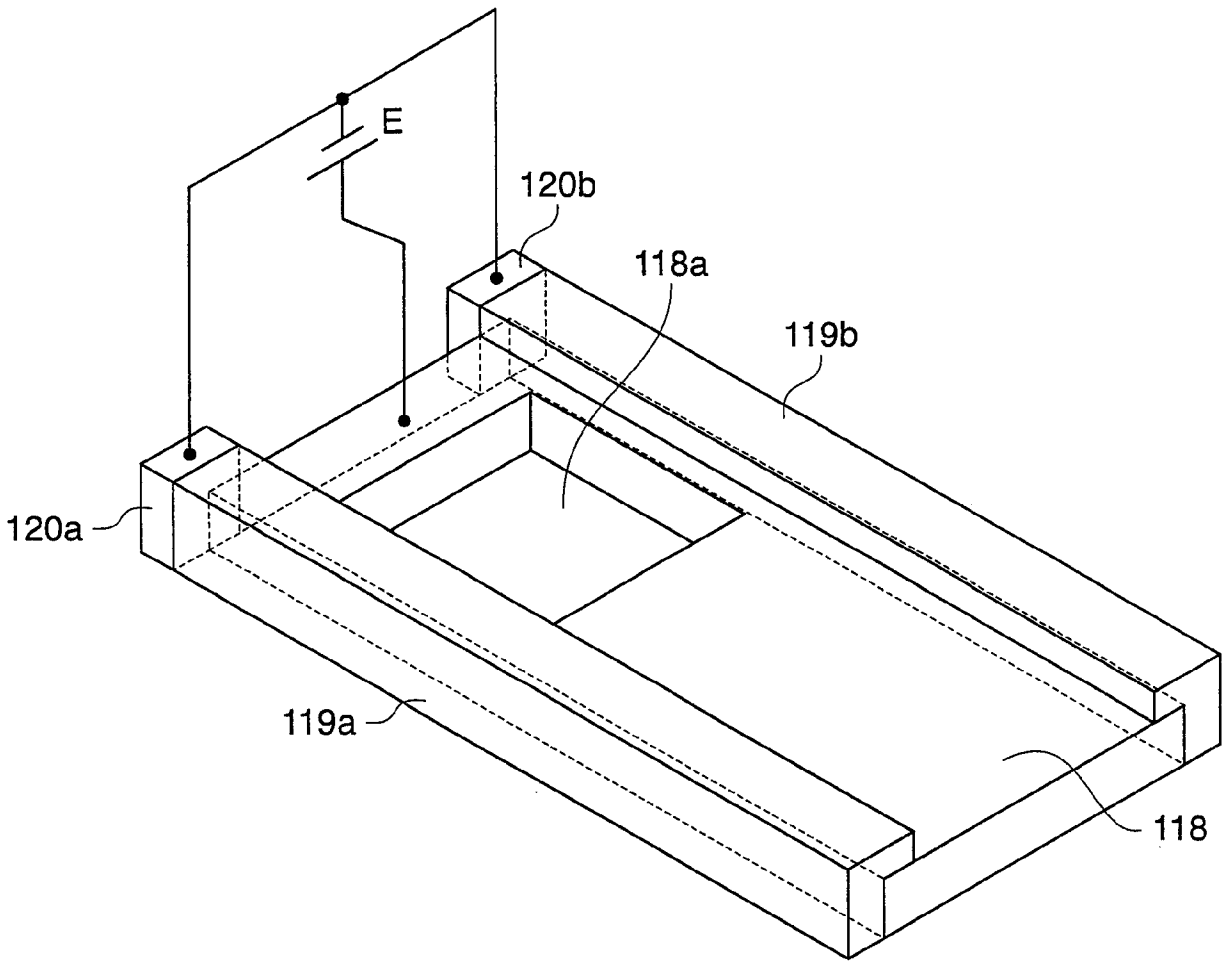
FIG. 5 is a perspective view of a shutter member including a shutter plate and a guide member according to Embodiment 1 of the present invention.
Figure 6:
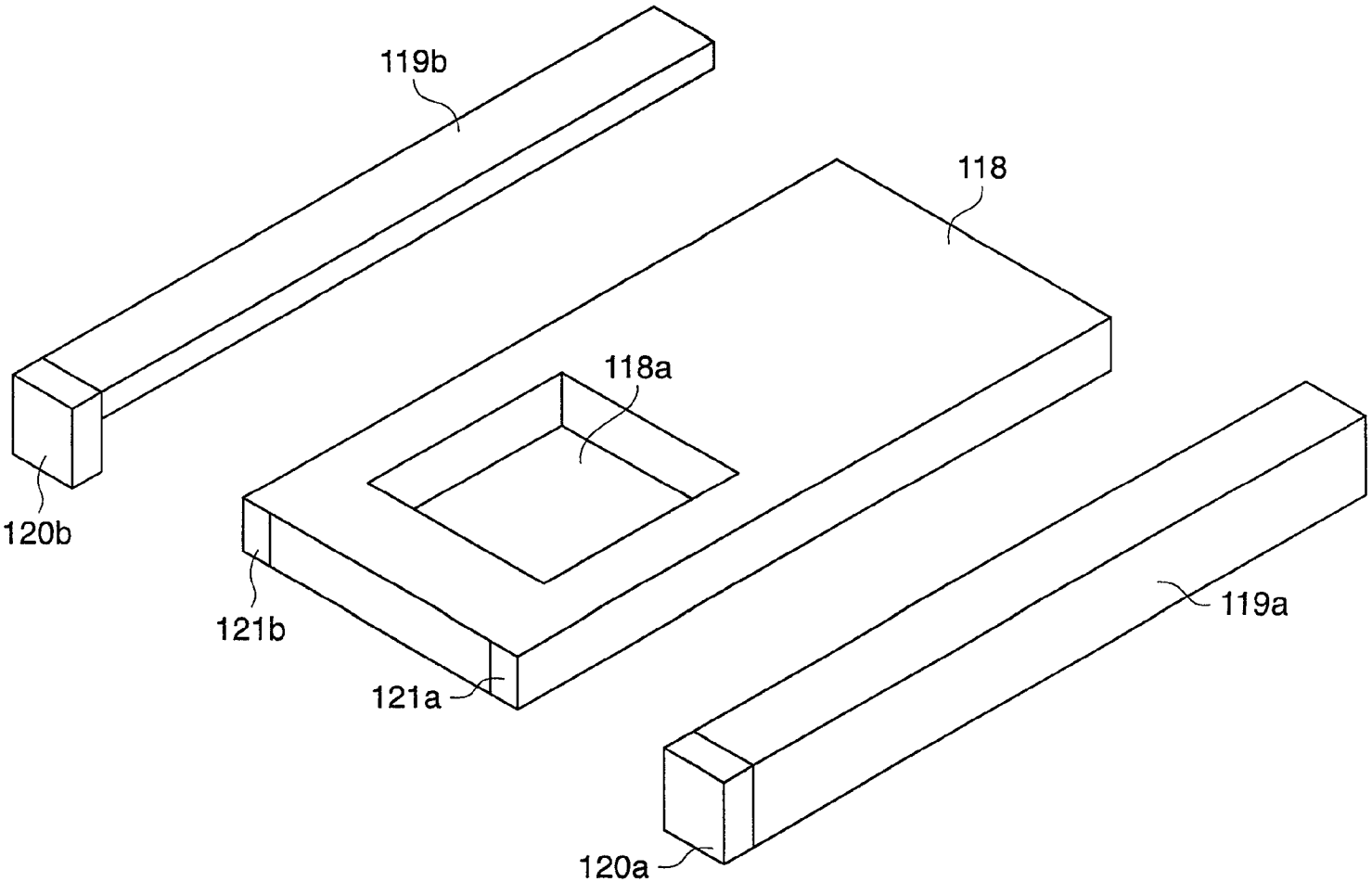
FIG. 6 is an exploded perspective view of the shutter member illustrated in FIG. 5.

FIG. 5 is a perspective view of the shutter plate 118 and the guide members 119*a*, 119*b* provided to the toner supplying port 117 of the developing tank cover 115; and FIG. 6 is an exploded perspective view of the shutter plate 118 and the guide members 119*a*, 119*b* in FIG. 5.

As illustrated in these drawings, the shutter plate 118 is a plate-like aluminum conductive member having a rectangular shutter aperture 118*a* and slidably supported on the developing tank cover 115 by the guide members 119*a*, 119*b*. As illustrated in FIG. 4, the toner supplying port 117 will be opened when the shutter plate 118 slides to a position where the shutter aperture 118*a* and the toner supplying port 117 overlap.

The guide members 119*a*, 119*b* illustrated in FIG. 5 and FIG. 6 are a long and narrow insulative member having an L-shaped cross section and being formed of a resin material.

The guide members 119*a*, 119*b* are provided with aluminum stoppers 120*a*, 120*b*, respectively at one end thereof for controlling the extent of the sliding of the shutter plate 118.

Figure 7:
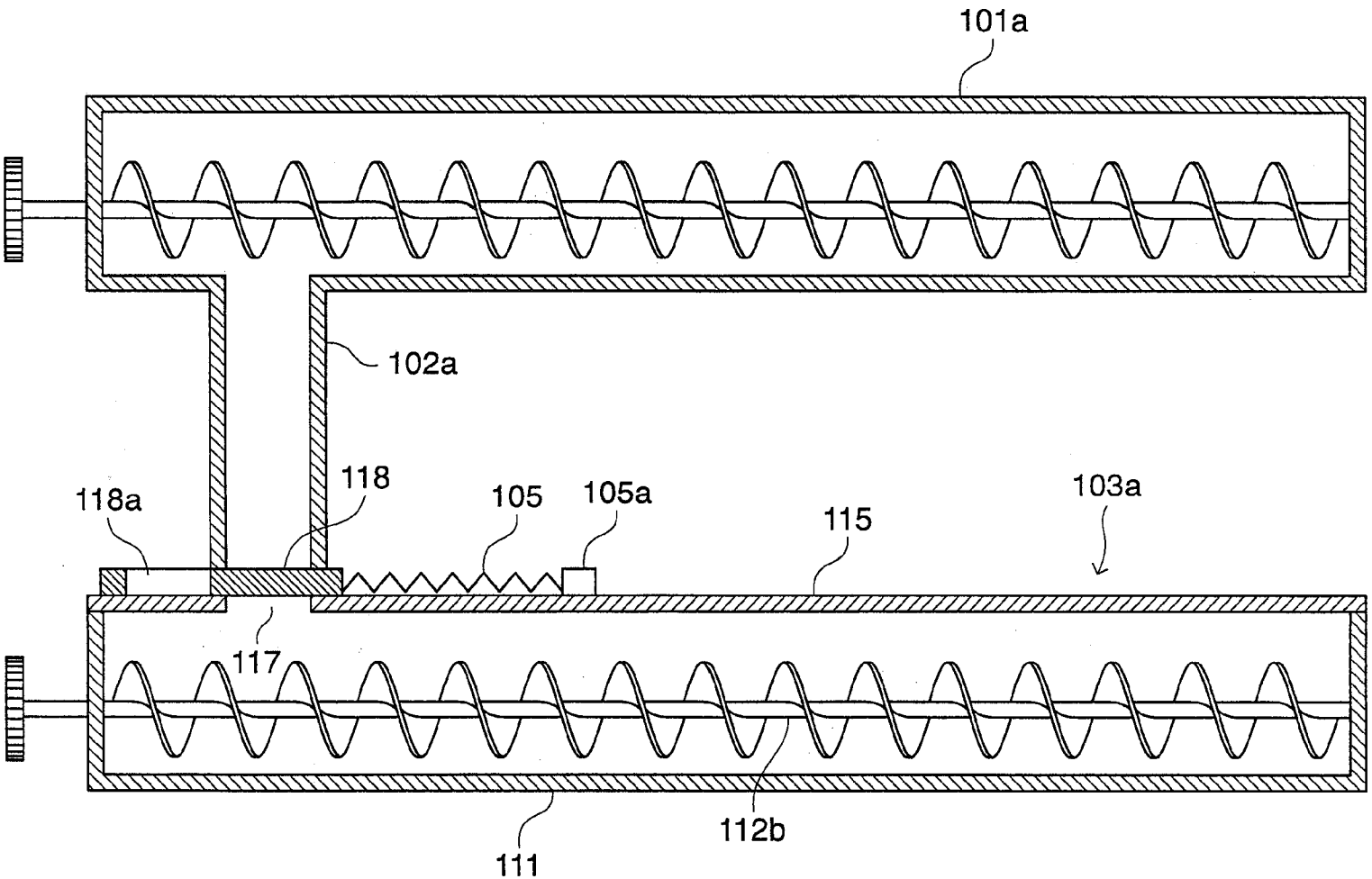
FIG. 7 is an explanatory diagram illustrating operation of the shutter plate according to Embodiment 1 of the present invention.

As illustrated in FIG. 6, the shutter plate 118 and the stoppers 120*a*, 120*b* are bonded together at contact surfaces 121*a*, 121*b* by the electrically-releasing adhesive. In other words, in a new developing cartridge 103*a*, the shutter plate 118 is closing the toner supplying port 117, resisting the biasing force of the elastic member 105 as illustrated in FIG. 7.

Here, the electrically-releasing adhesive refers to an adhesive that contains a composition whose bond can be electrochemically released and that decreases in its adhesive force in a composition face (interface) joining to an adhesion object in consequence of a bond-releasing reaction caused by an electric current applied thereto. As the electrically-releasing adhesive, for example, an adhesive produced by the method disclosed in Japanese Unexamined Patent Application Publication (Translation of PCT Application) No. 2003-504504 or commercialized products may be used. Examples of the commercialized products of the electrically-releasing adhesive include "ElectRelease (Electrically-Debonding Adhesive)", trade name, product by EIC (EIC Laboratories, Inc.) The above-mentioned electrically-releasing adhesive has a characteristic of undergoing bond-releasing at an interface with an adhesion object electrically connected to an anode when an electric current is sent thereto.

When an electric current is sent from a DC power source E to the side of the shutter plate 118 as the first conductive member as an anode and the side of the stoppers 120*a*, 120*b* as the second conductive member as a cathode with an electric wiring as illustrated in FIG. 5, the electrically-releasing adhesive undergoes bond-releasing selectively, that is, decreases in its adhesive strength only at an interface with the stoppers 120*a*, 120*b*, and the electrically-releasing adhesive is therefore released from the interface while remaining stuck to the stoppers 120*a*, 120*b*.

While the shutter plate 118 functions as the first conductive member and the stoppers 120*a*, 120*b* function as the second conductive member in this embodiment, electrodes such as copper plates may be fixed on the respective surfaces of the shutter plate 118 and the stoppers 120*a*, 120*b*, and the electrodes may be used as the first conductive member and the second conductive member. In this case, when an electric current is sent from the DC power source E to the copper plate fixed on the shutter plate 118 as an anode and the copper plate fixed on the stoppers 120*a*, 120*b* as a cathode with an electric wiring, the electrically-releasing adhesive is released from the above-mentioned interface while remaining stuck to the copper plate fixed on the stoppers 120*a*, 120*b*.

Figure 8:
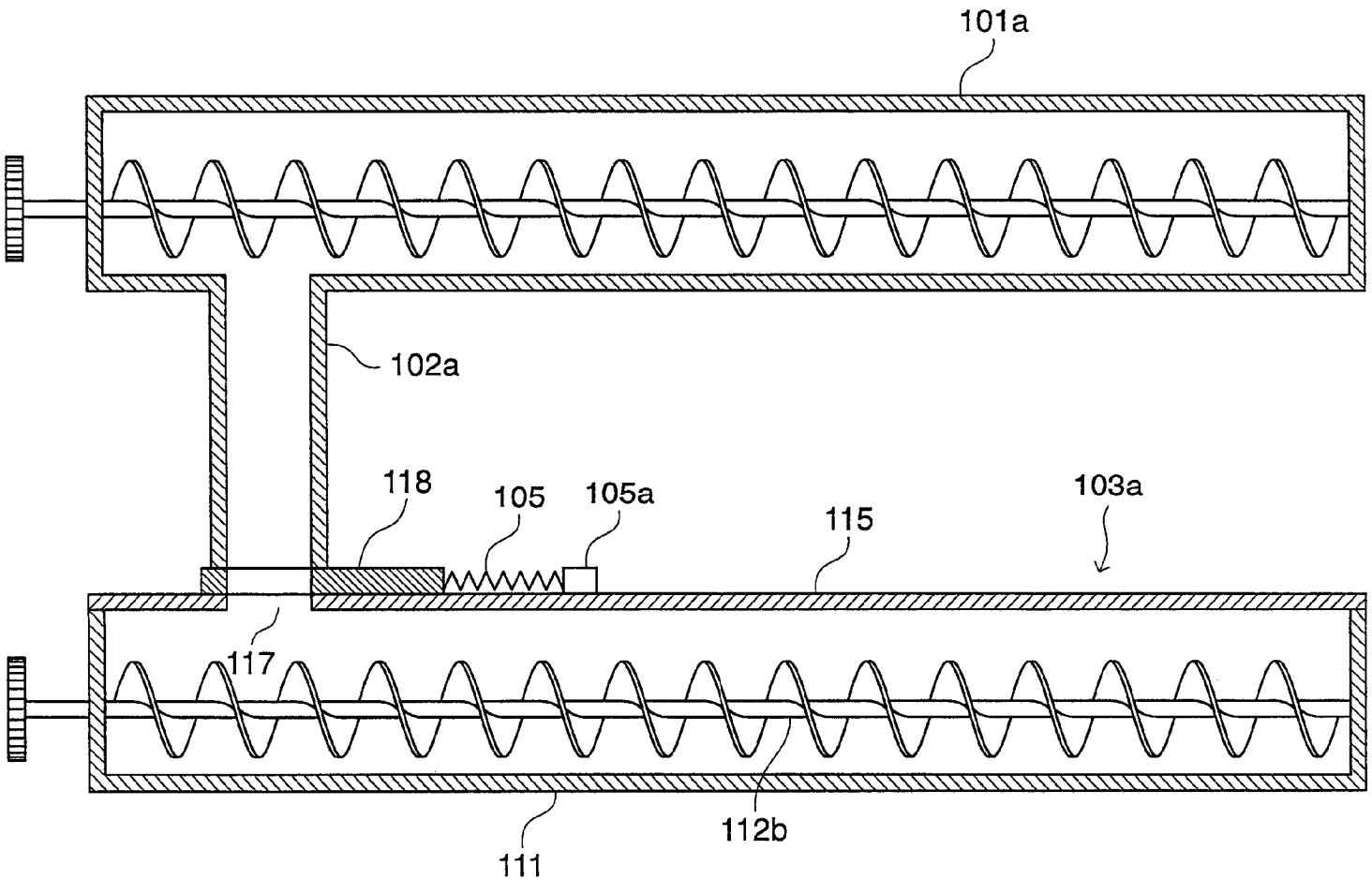
FIG. 8 is an explanatory diagram illustrating operation of the shutter plate according to Embodiment 1 of the present invention.

FIG. 7 illustrates the shutter plate immediately after the developing cartridge 103*a* is loaded in a lower part of the toner transport mechanism 102*a* of the toner hopper 101*a* in the image forming apparatus 100; and FIG. 8 illustrates the shutter plate after the electrically-releasing adhesive is released by the action of electricity.

In the developing cartridge 103*a* loaded in the image forming apparatus 100, the shutter plate 118 is bonded to the stoppers 120*a*, 120*b* by the electrically-releasing adhesive, and the toner supplying port 117 is closed as illustrated in FIG. 7. When the electrically-releasing adhesive is released by the action of electricity, the shutter plate 118 slides by receiving a biasing force of the elastic member 105 whose one end is supported by the supporting part 105*a*, thereby opening the toner supplying port 117 as illustrated in FIG. 8.

Modification

Figure 18:
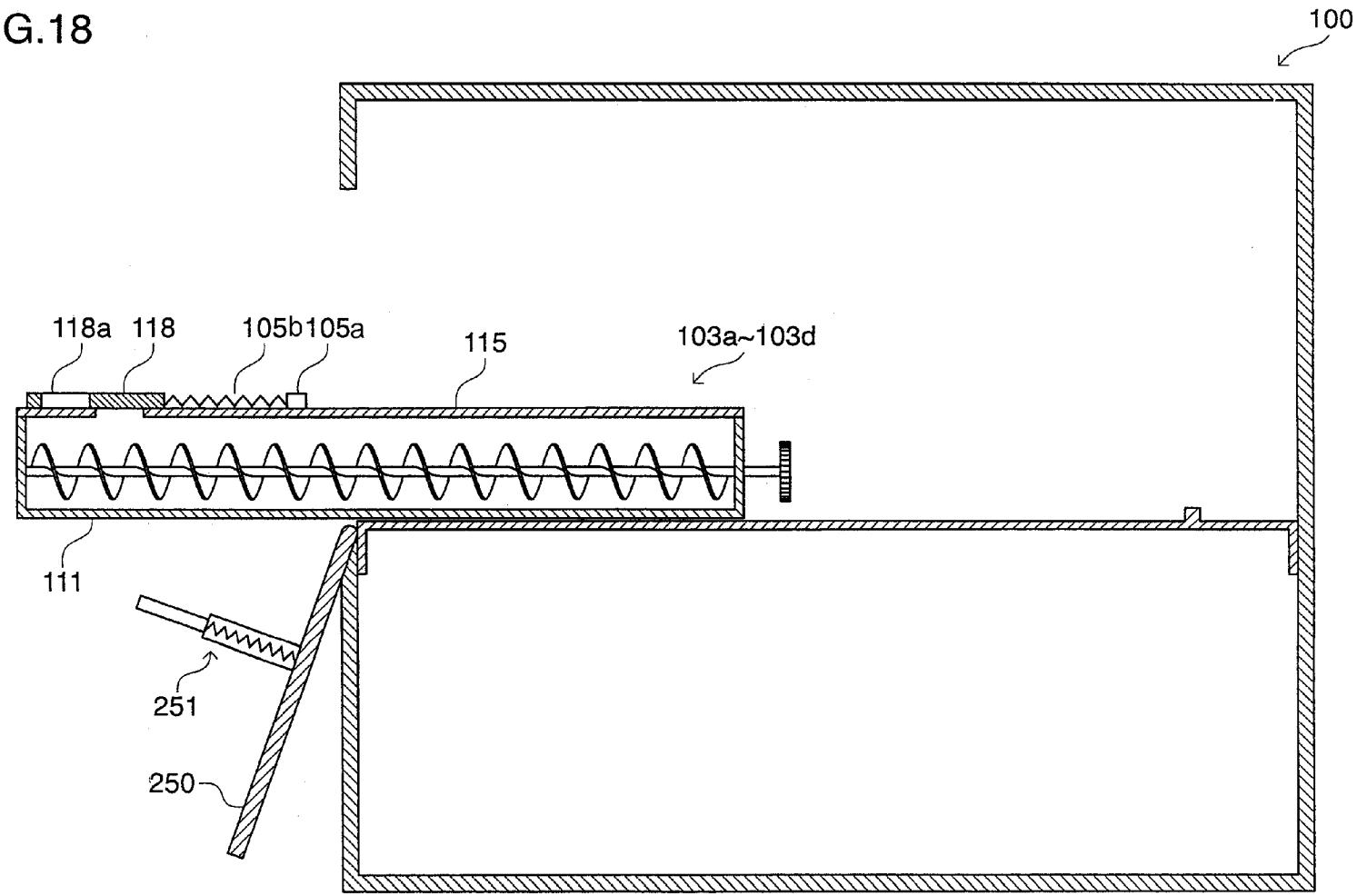
FIG. 18 is an explanatory diagram illustrating a modification of Embodiment 1.
Figure 19:
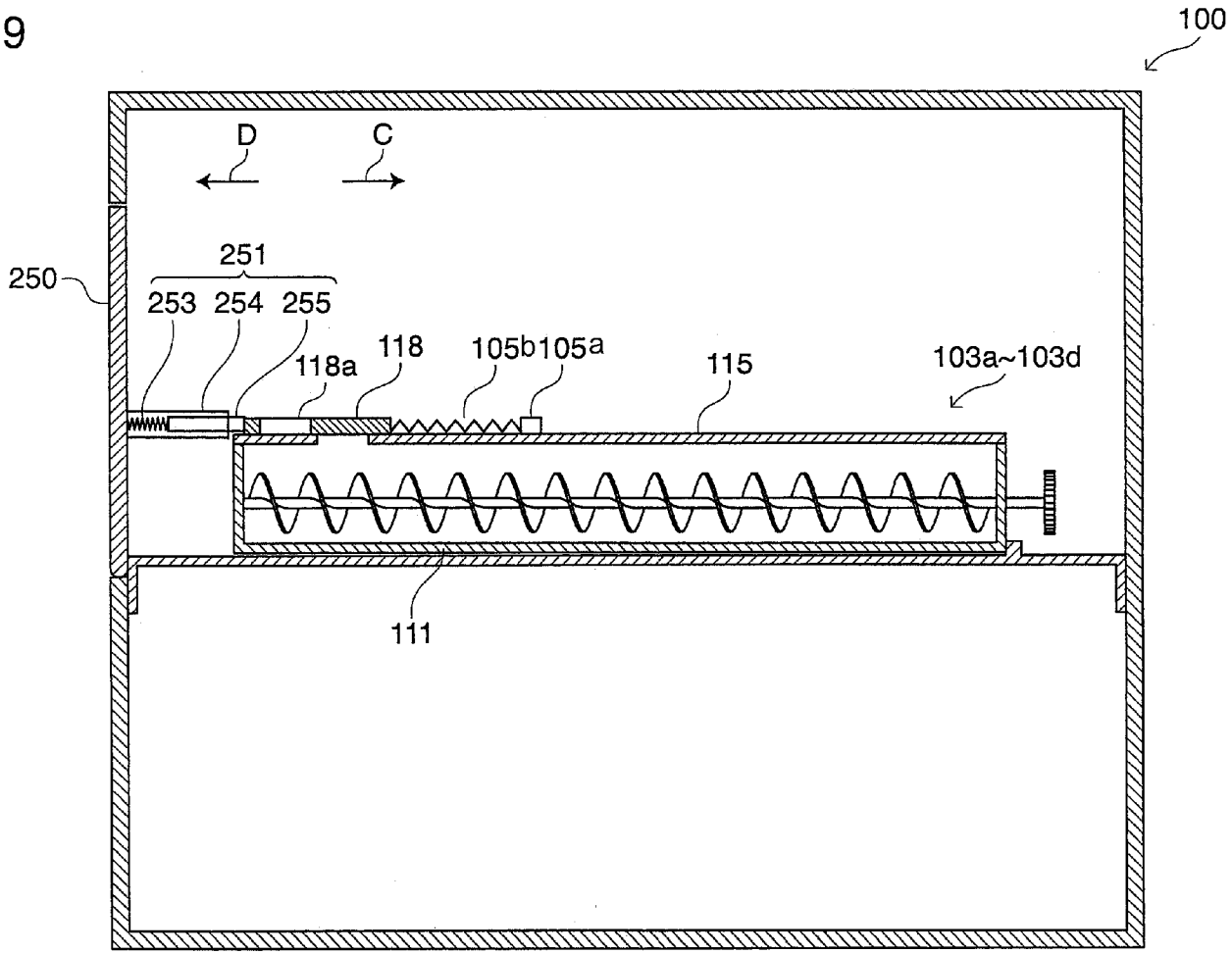
FIG. 19 is an explanatory diagram illustrating the modification of Embodiment 1.
Figure 20:
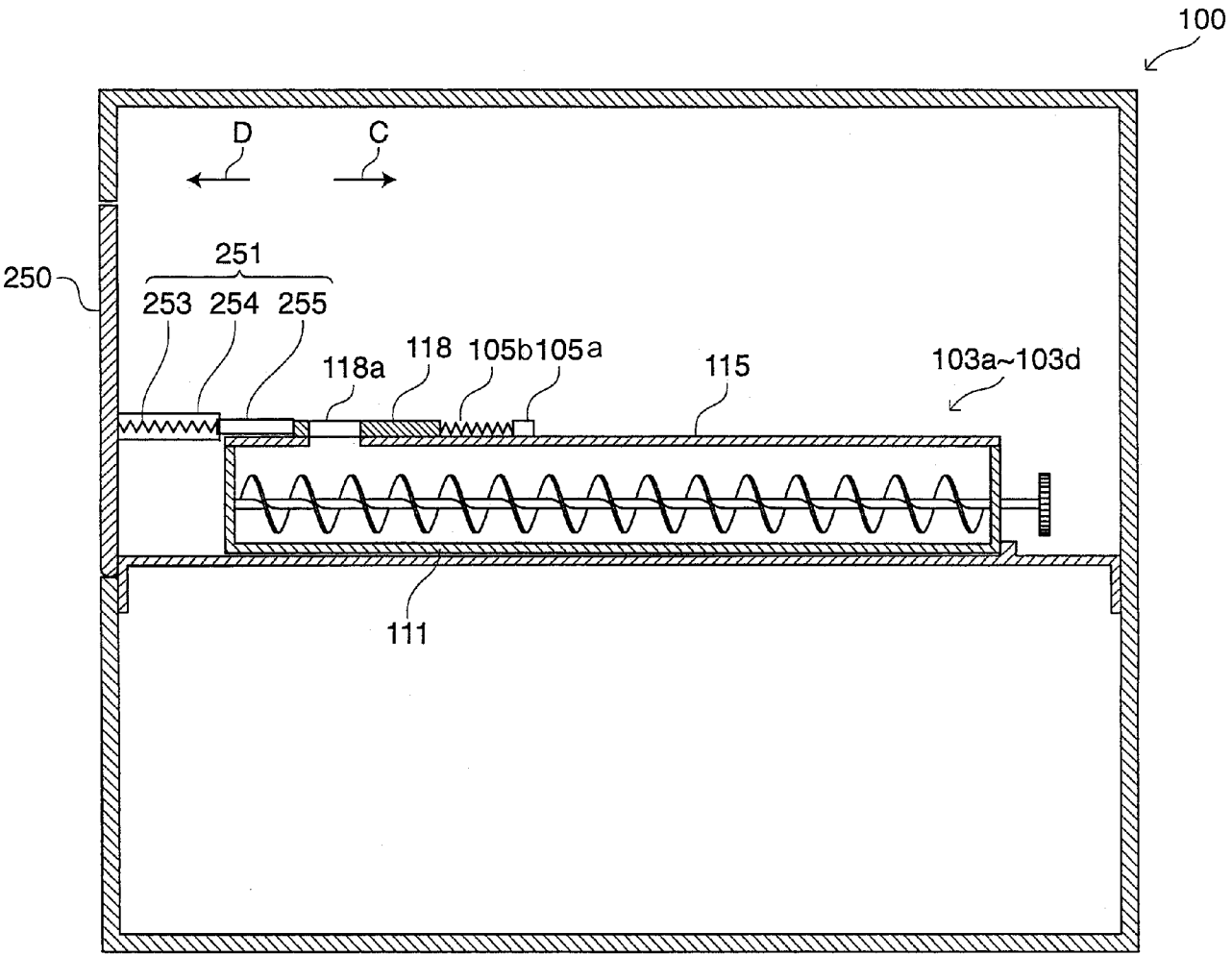
FIG. 20 is an explanatory diagram illustrating the modification of Embodiment 1.

FIG. 18 to FIG. 20 illustrate a modification of Embodiment 1.

As the elastic member 105, Embodiment 1 uses the pull spring 105 that pulls the shutter plate 118 in a direction in which the toner supplying port 117 is opened; on the other hand, the modification illustrated in FIG. 18 to FIG. 20 uses a press spring 105*b* that biases the shutter plate 118 in an arrow D direction in which the toner supplying port 117 is closed.

FIG. 18 illustrates the modification of Embodiment 1 when a front cover 250 of the image forming apparatus 100 is opened and one of the developing cartridges 103*a* to 103*d* (hereinafter, referred to as developing cartridge 103) is being mounted; FIG. 19 illustrates the modification of Embodiment 1 when the developing cartridge 103 is mounted in the image forming apparatus 100 and immediately after the front cover 250 is closed (before an electric current is sent to the electrically-releasing adhesive); and FIG. 20 illustrates the modification of Embodiment 1 when the shutter plate 118 is opened after an electric current is sent to the electrically-releasing adhesive.

As illustrated in FIG. 18 to FIG. 20, the front cover 250 is provided on a front face (side facing users) of the image forming apparatus 100 for putting in and out the developing cartridge 103. A shutter opening member 251 is fixed to the front cover 250 so as to press the shutter plate 118 in an arrow C direction when the front cover 250 is closed. The shutter opening member 251 comprises a piston 255, a press spring 253 for pushing the piston 255, and a cylinder 254 for holding the piston 255 in such a manner that the piston 255 is slidable in an axial direction.

When the developing cartridge 103 is mounted at a predetermined position in the image forming apparatus 100 and the front cover 250 is closed, the press spring 253 biases the shutter plate 118 in the arrow C direction and, when an electric current is sent to the electrically-releasing adhesive, opens the toner supplying port 117, overcoming the biasing force of the press spring 105*b*. With such a configuration, the toner supplying port 117 is automatically closed by the biasing force of the press spring 105*b* when the developing cartridge 103 is removed from the image forming apparatus 100, that is, when the front cover 250 is opened.

Embodiment 2

Figure 11:
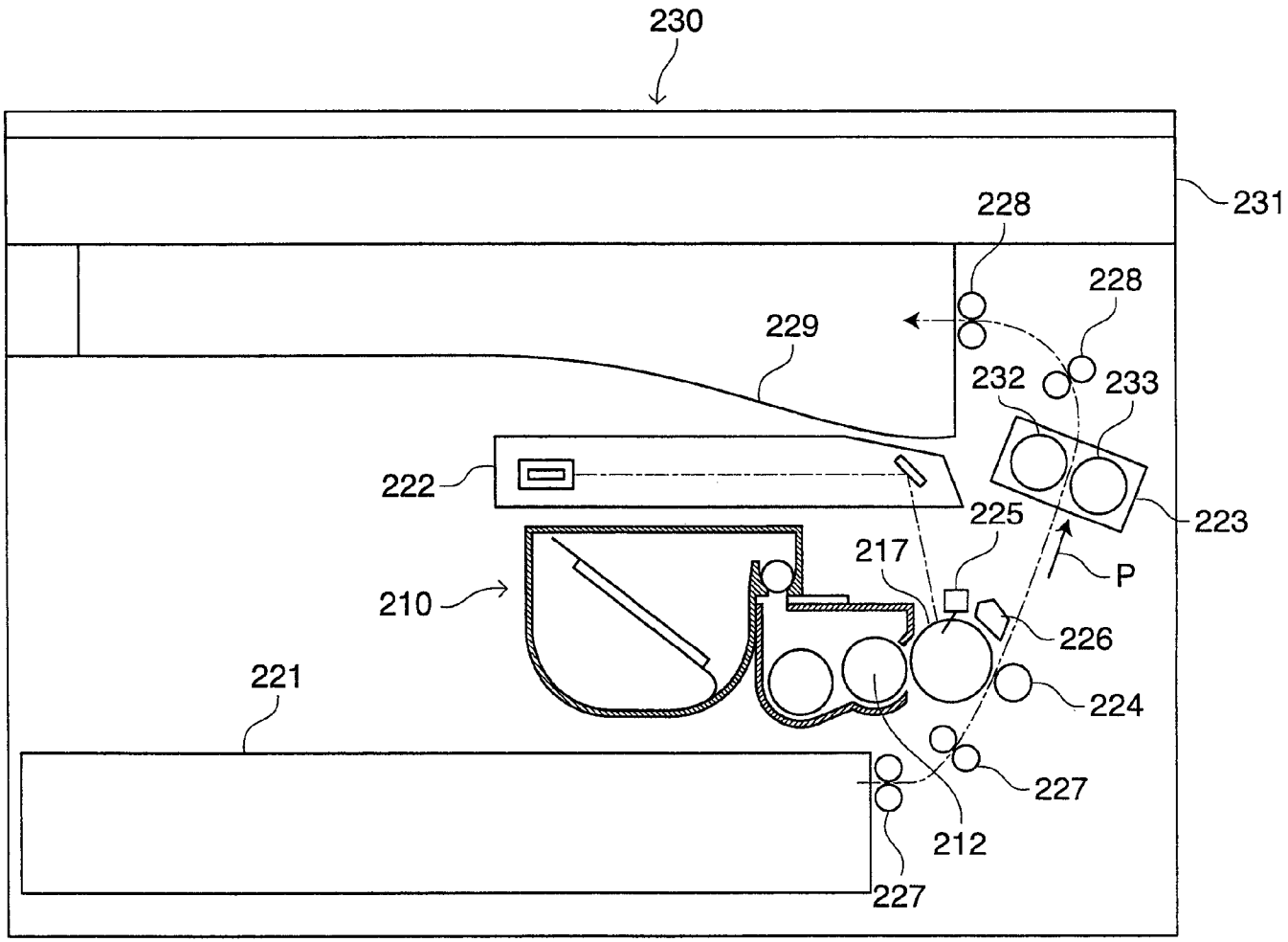
FIG. 11 is an explanatory diagram illustrating a configuration of an image forming apparatus according to Embodiment 2 of the present invention.

FIG. 11 is an explanatory diagram illustrating an internal configuration of an image forming apparatus 230 according to Embodiment 2 of the present invention. The image forming apparatus 230 comprises: a toner supplying device bearing developing cartridge (hereinafter, referred to as toner cartridge) 210, a photosensitive drum 217, a charging device 225, an exposure device 222, a cleaning device 226, a transfer device 224, a fixing device 223, a sheet feeding cassette 221, a sheet exit tray 229, and a scanner unit 231.

The photosensitive drum 217 is supported by a driving means, not shown, so that it can be driven rotationally around an axis. And, the photosensitive drum 217 is a roller-shaped member having a photosensitive surface on which an electrostatic latent image, eventually a toner image, is formed. As the photosensitive drum 217, for example, a roller-shaped member that includes a conductive substrate, not shown, and a photosensitive surface, not shown, formed on a surface of the conductive substrate may be used. As the conductive substrate, cylindrical, columnar, and sheet conductive substrates may be used, among which the cylindrical conductive substrate is preferable. Examples of the photosensitive surface include an organic photosensitive drum, an inorganic photosensitive surface, and the like.

Examples of the organic photosensitive surface include a layered photoconductor of a charge generation layer which is a resin layer containing a charge generation material and a charge transfer layer which is a resin layer containing a charge transfer material; a monolayer photoconductor containing a charge generation material and a charge transfer material in one resin layer; and the like. Examples of the inorganic photosensitive surface include a film containing one kind, or two or more kinds selected from zinc oxide, selenium, amorphous silicon, and the like. The conductive substrate and the photosensitive surface may be provided with a base film therebetween, and the photosensitive surface may be provided with a surface film (protective film) for mainly protecting the photosensitive surface.

The charging device 225 is a sawtooth-shaped charger that performs corona discharge to the photosensitive drum 217. A power source, not shown, is connected to the charging device 225 to apply a voltage to the charging device 225. Receiving the application of a voltage from the power source, the charging device 225 charges the surface of the photosensitive drum 217 at a predetermined polarity and potential. Other than the sawtooth-shaped charger, chargers of a contact system such as a charger-type charger, a charging-brush-type charger, a roller-shaped charger, a magnetism brush, and the like may be used.

The exposure device 222 applies signal light according to image information, which is image information of a document read and inputted in the scanner unit 231 or image information obtained from an external device, to the surface of the photosensitive drum 217 in a charged state. Thereby, an electrostatic latent image according to the image information is formed on the surface of the photosensitive drum 217. The formed electrostatic latent image is developed into a toner image with a toner supplied from the toner cartridge 210. Here, as the exposure device 222, a laser scanning device including a light source is used. The laser scanning device is a device obtained by combining, for example, a light source, a polygon mirror, an fθ lens, a reflection mirror, and the like. As the light source, for example, a semiconductor laser, an LED array, an electroluminescence (EL) element, and the like may be used.

The transfer device 224 is a roller-shaped member that is supported by a supporting member, not shown, in a freely rotatable manner and provided so as to be rotatable by a driving means, not shown, and so as to be in pressed contact with the photosensitive drum 217. As the transfer device 224, for example, a roller-shaped member including a metal cored bar having a diameter of 8 mm to 10 mm and a conductive elastic layer formed on a surface of the metal cored bar may be used. As metals for forming the metal cored bar, stainless steel, aluminum, and the like may be used.

For the conductive elastic layer, rubber materials obtained by combining a conductive material such as carbon black with a rubber material such as ethylene-propylene rubber (EPDM), foamed EPDM, foamed urethane, and the like may be used. Synchronizing with a toner image being conveyed to a part of the pressed contact between the photosensitive drum 217 and the transfer device 224 (transfer nip part) by rotation of the photosensitive drum 217, a recording medium is fed from the sheet feeding cassette 221 via sheet feeding rollers 227 one by one.

The recording medium goes through the transfer nip part, and the toner image on the surface of the photosensitive drum 217 is thereby transferred to the recording medium. A power source, not shown, is connected to the transfer device 224 for applying a voltage of a polarity opposite to the charge polarity of the toner for forming the toner image to the transfer device 224 when the toner image is transferred to the recording medium. Thereby, the toner image is transferred to the recording medium smoothly. The recording medium is fed to the fixing device 223 along an arrow P direction.

The cleaning device 226 includes a cleaning blade and a toner storage tank. The cleaning blade is a plate-like member provided so that it extends in parallel with a longer direction of the photosensitive drum 217 and so that one end thereof in a shorter direction of the photosensitive drum 217 contacts with the surface of the photosensitive drum 217.

The cleaning blade removes toner, paper particles, and the like that remain on the surface of the photosensitive drum 217 from the surface of the photosensitive drum 217 after the transfer of the toner image to the recording medium. The toner storage tank is a container-shaped member having an internal space, and it temporarily stores the toner removed by the cleaning blade. The surface of the photosensitive drum 217 is cleaned by the cleaning device 226 after the transfer of the toner image.

The fixing device 223 includes a fixing roller 232 and a pressure roller 233. The fixing roller 232 is a roller-shaped member that is provided rotatably. The fixing roller 232 has a heating member therein, and it heats and fuses the toner for forming an unfixed toner image borne by the recording medium conveyed from the transfer nip part to fix the toner onto the recording medium.

As the fixing roller 232, for example, a roller-shaped member including a cored bar and an elastic layer is used. The cored bar is formed of a metal such as iron, stainless, and aluminum. The elastic layer is formed of an elastic material such as a silicone rubber and a fluorine-containing rubber, for example. The heating member undergoes voltage application from a power source, not shown, and generates heat. As the heating member, a halogen lamp, an infrared lamp, and the like may be used.

The pressure roller 233 is a roller-shaped member that is supported in a freely rotatable manner and provided so as to be in pressed contact against the fixing roller 232. The pressure roller 233 rotates by being driven by rotation of the fixing roller 232. A part of the pressed contact between the fixing roller 232 and the pressure roller 233 is a fixing nip part. The pressure roller 233 accelerates fixation of the toner image to the recording medium by pressing the toner in a fused state against the recording medium on the occasion of the heating fixation of the toner image onto the recording medium by the fixing roller 232. As the pressure roller 233, a roller-shaped member having the same structure as of the fixing roller 232 may be used. A heating member may be provided also to the inside of the pressure roller 233. As the heating member, the same kind as the heating member in the fixing roller 232 may be used.

In the fixing device 223, the toner for forming the toner image is fused and pressed against the recording medium, when the recording medium on which the toner image is transferred goes through the fixing nip part, and the toner image is thereby fixed onto the recording medium. The recording medium on which the image is printed is ejected to the sheet exit tray 229 via sheet exit rollers 228.

The sheet feeding cassette 221 is a tray for containing a recording medium such as regular paper, coated paper, color copying paper, and OHP films. Synchronizing with a toner image on the surface of the photosensitive drum 217 being conveyed to the transfer nip part by a pickup roller, not shown, and the sheet feeding roller 227, a recording medium is fed one by one.

The scanner unit 231 is provided with a document setting tray, not shown, a reversing automatic document feeder (RADF), and a document reader, not shown. The automatic document feeder conveys a document mounted in the document setting tray to a document mounting table in the document reader. The document reader includes the document mounting table, a document scanner, a reflection member, a photoelectric conversion element (hereinafter, referred to as "CCD") line sensor, and the like, and it reads image information of a document mounted in the document mounting table on a plural-line basis, for example, every ten lines. The document mounting table is a glass plate-like member for mounting a document whose image information is to be read.

The document scanner includes a light source and a first reflection mirror, not shown, and it reciprocates at a constant rate V in parallel with a lower face in a vertical direction of the document mounting table and applies light to a surface, on which the image is formed, of the document mounted in the document mounting table. As a result of the application of light, an image of reflected light is obtained. The light source is a source of light to be applied to the document mounted in the document mounting table. The first reflection mirror reflects the image of reflected light onto the reflection member.

The reflection member includes a second reflection mirror, a third reflection mirror, and an optical lens, not shown, and it forms the image of reflected light obtained in the document scanner on the CCD line sensor. The reflection member reciprocates at a rate of V/2, following the reciprocation of the document scanner. The second and third reflection mirrors reflect the image of reflected light so that the image of reflected light heads for the optical lens.

The optical lens forms the image of reflected light on the CCD line sensor. The CCD line sensor includes a CCD circuit, not shown, for photoelectrically converting the image of reflected light that has been formed by the optical lens into an electrical signal, and it outputs the electrical signal as image information to an image processing section in a control means. The image processing section converts image information inputted from an external device such as a document reader, a personal computer, and the like into an electrical signal and outputs the signal to the exposure device 222.

Figure 12:
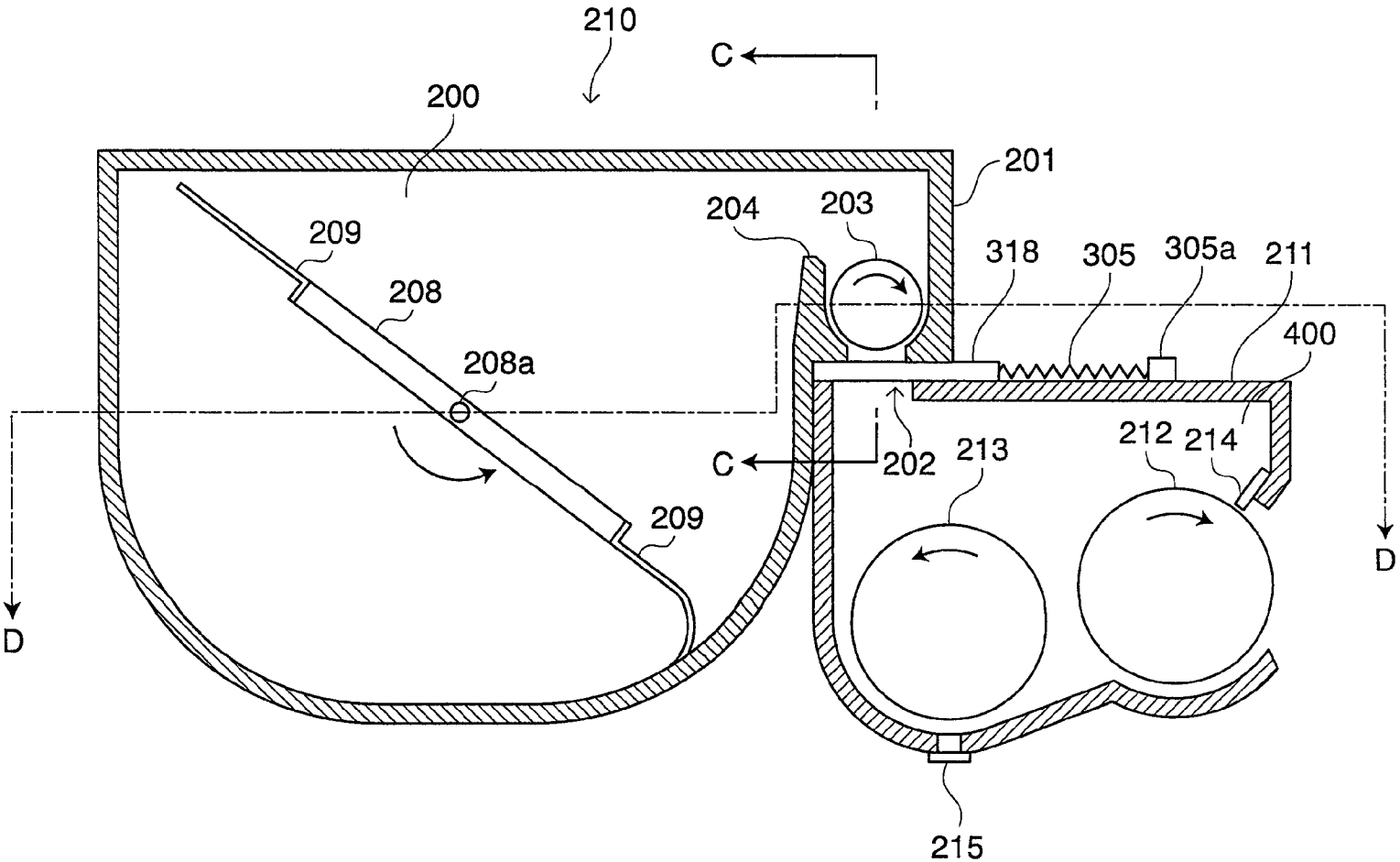
FIG. 12 is a sectional view of a toner cartridge according to Embodiment 2 of the present invention.
Figure 13:
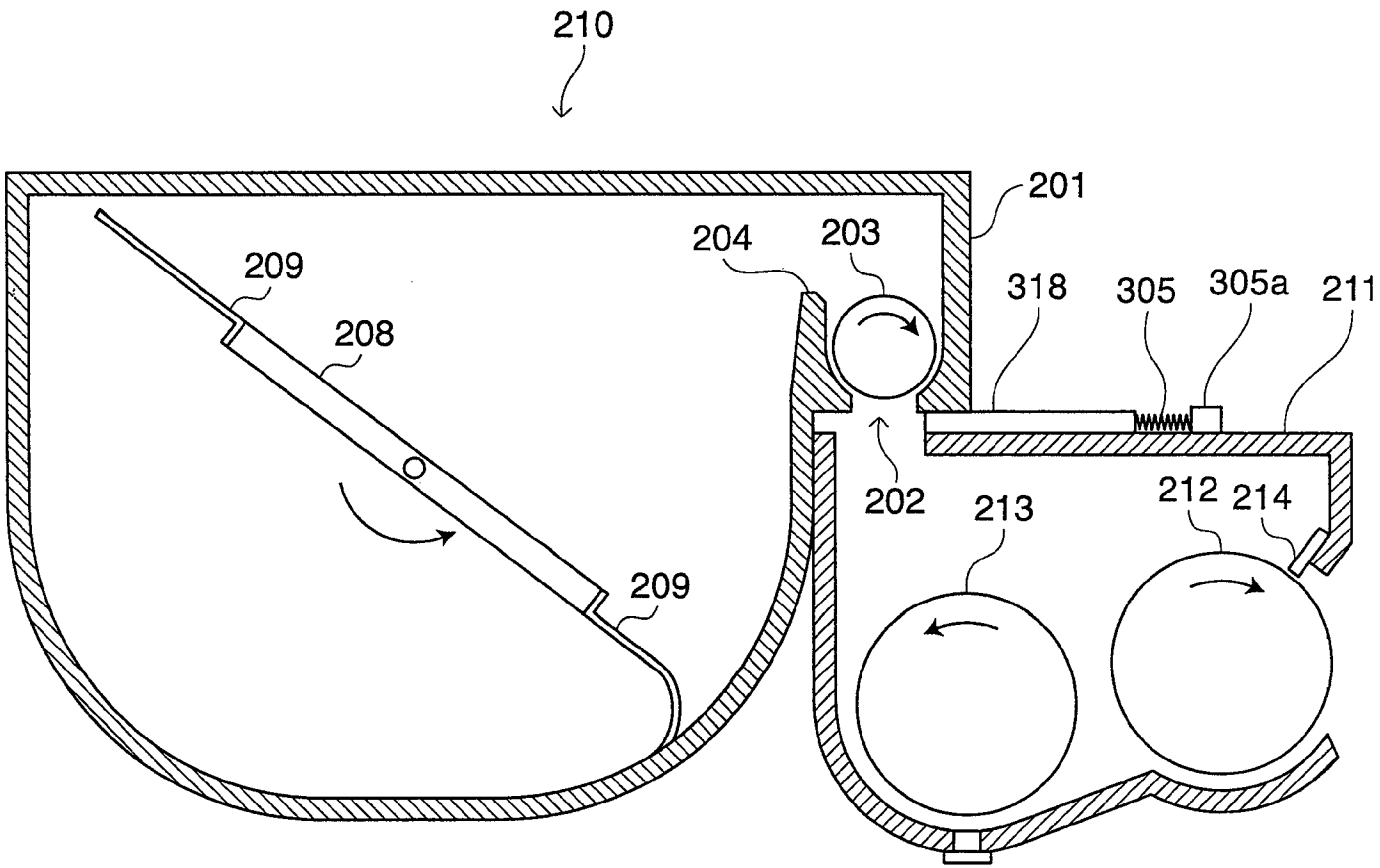
FIG. 13 is an explanatory diagram illustrating operation of the toner cartridge according to Embodiment 2 of the present invention.

FIG. 12 and FIG. 13 are sectional views schematically illustrating a configuration of the toner cartridge 210. FIG. 12 illustrates the toner cartridge 210 immediately after it is loaded in the image forming apparatus 230, and when a toner supplying port 202 is closed. FIG. 13 illustrates the toner cartridge 210 after an electrically-releasing adhesive is released by the action of electricity, and when the toner supplying port 202 is opened.

Figure 14:
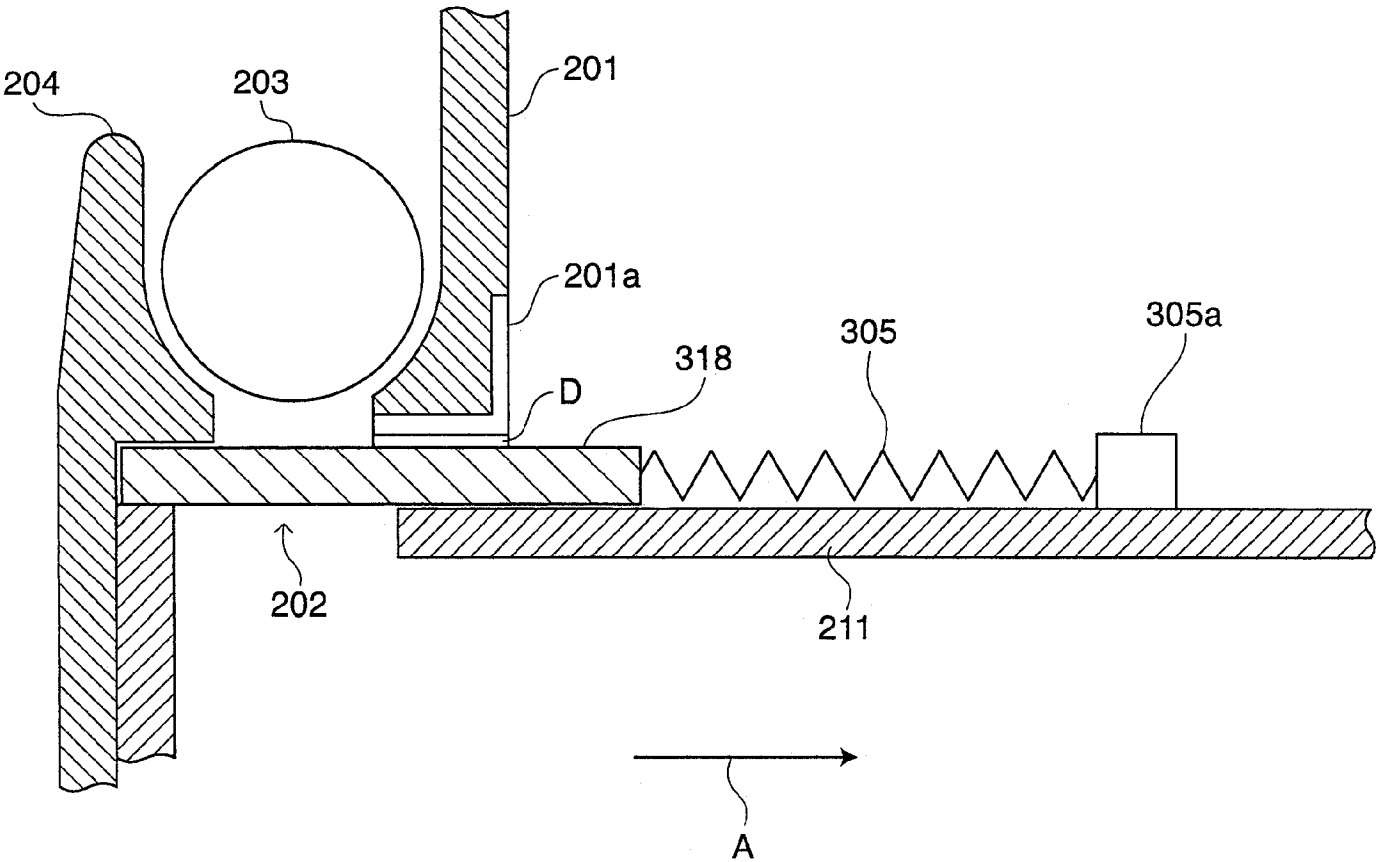
FIG. 14 is an enlarged view of a major portion of FIG. 12.
Figure 15:
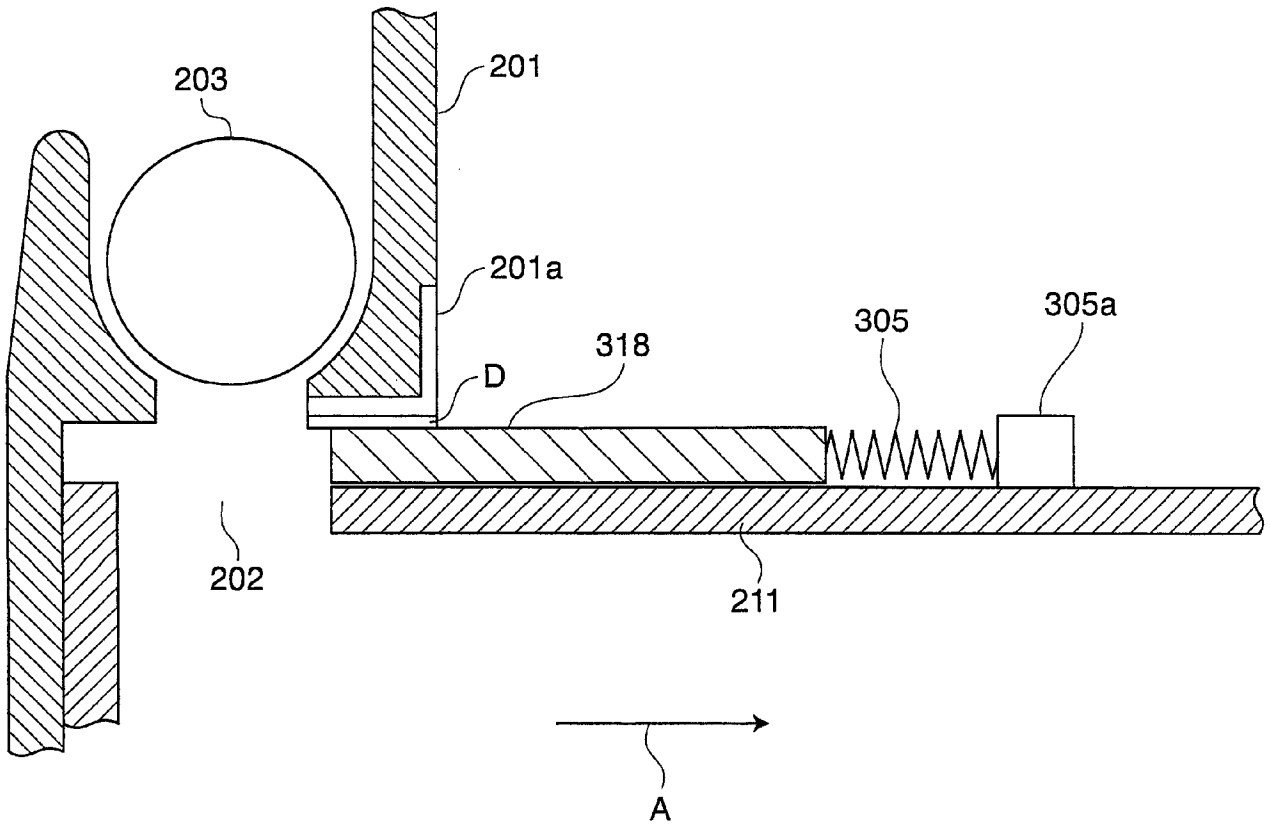
FIG. 15 is an enlarged view of a major portion of FIG. 13.

FIG. 14 and FIG. 15 are enlarged views of a major portion of FIG. 12 and FIG. 13. FIG. 14 illustrates the toner cartridge 210 immediately after it is loaded in the image forming apparatus 230, and when the toner supplying port 202 is closed. FIG. 15 illustrates the toner cartridge 210 after the electrically-releasing adhesive is released by the action of electricity, and when the toner supplying port 202 is opened.

Figure 16:
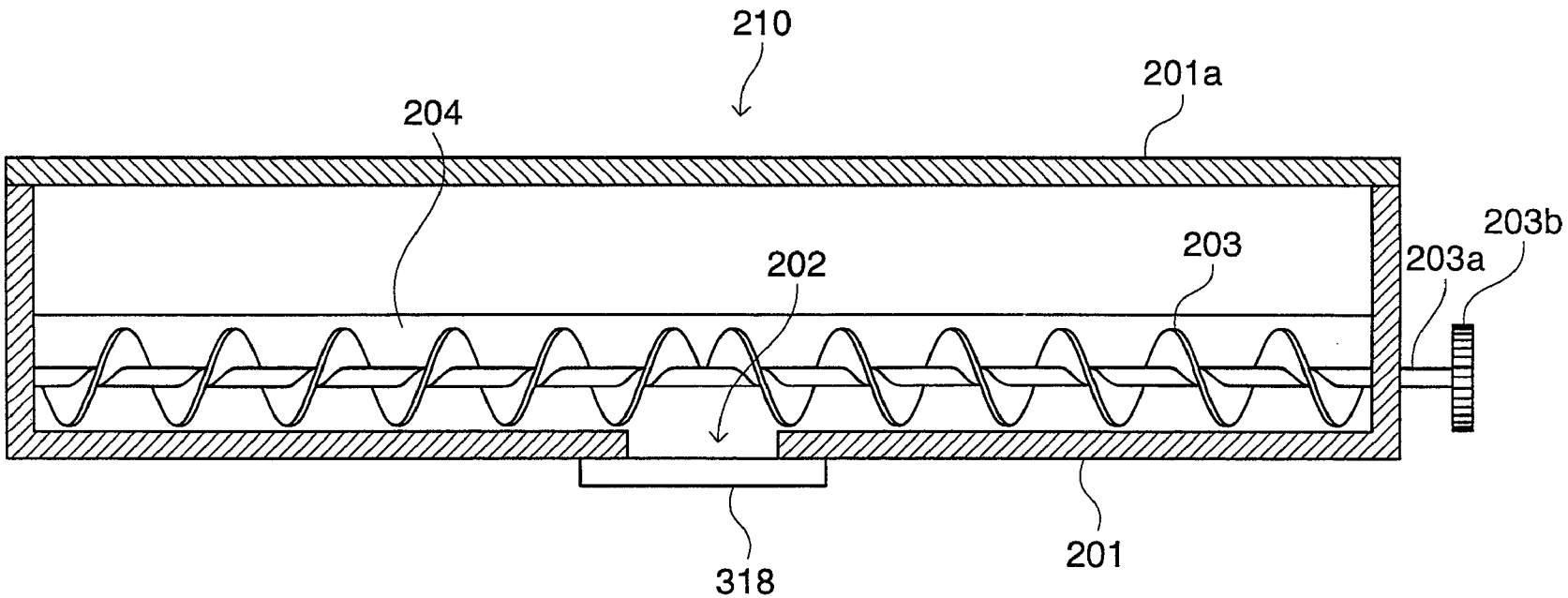
FIG. 16 is a sectional view as seen from an arrow direction C-C in FIG. 12.
Figure 17:
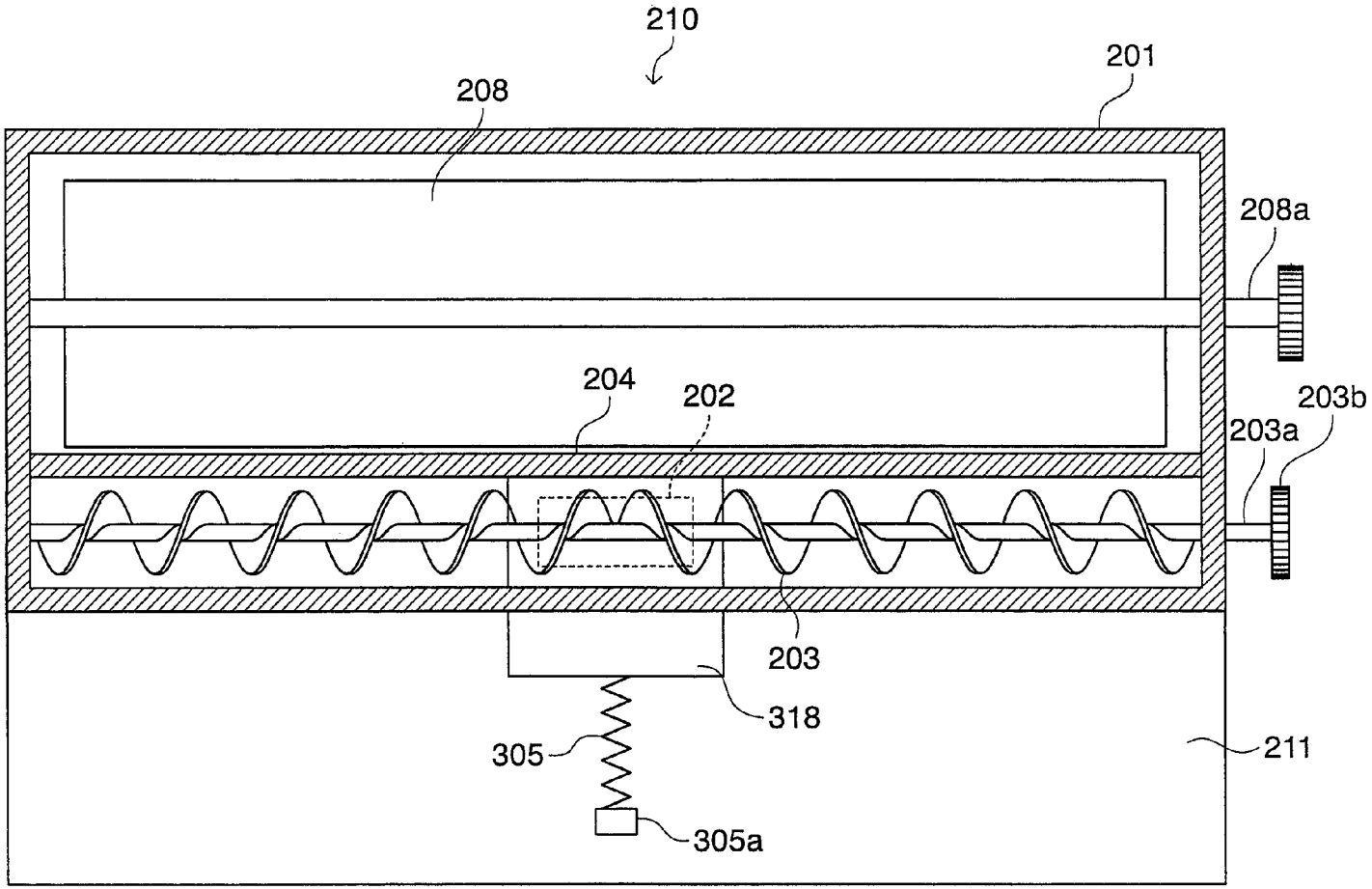
FIG. 17 is a sectional view as seen from an arrow direction D-D in FIG. 12.

FIG. 16 is a sectional view as seen from an arrow direction C-C in FIG. 12; and FIG. 17 is a sectional view as seen from an arrow direction D-D in FIG. 12. As illustrated in FIG. 12, the toner cartridge 210 comprises a toner supplying device 200 and a developing device 400.

The toner supplying device 200 comprises a toner storage container 201, a toner stirring member 208, toner drawing blades 209, a toner discharging member 203, and the toner supplying port 202.

The toner storage container 201 is an approximately semi-cylindrical container having an internal space, and it supports the toner stirring member 208 and the toner discharging member 203 in a freely rotatable manner, and contains a toner. The toner supplying port 202 is a rectangular aperture provided under the toner discharging member 203 and in the middle of an axial direction.

The toner stirring member 208 stirs the toner contained in the toner storage container 201 by rotating around a rotation axis 208*a*. The toner drawing blades 209 are formed of a polyethylene terephthalate (PET) sheet having flexibility and attached to the both ends of the toner stirring member 208 for drawing the toner in the toner storage container 201 and conveying the toner to the toner discharging member 203.

The toner discharging member 203 supplies the toner conveyed by the toner drawing blades 209 from the toner supplying port 202 to a developing tank 211, and it comprises a toner discharging member rotation axis 203*a*, a discharge gear 203*b*, and the toner discharging member 203 as illustrated in FIG. 16. The toner discharging member 203 is formed of a screw auger or a spiral coil and rotated by the driving force of a drive motor, not shown, via the discharge gear 203*b*. The orientation of the screw auger or the spiral coil is set so that the toner is conveyed in directions from both ends of the axis of the toner discharging member 203 toward the toner supplying port 202 as illustrated in FIG. 17.

There is provided a toner discharging member partitioning wall 204 between the toner discharging member 203 and the toner stirring member 208. Thereby, the toner drawn by the toner stirring member 208 can be stored up around the toner discharging member 203.

The toner stirring member 208 rotates in the arrow direction to stir the toner, and the toner drawing blades 209 draws the toner toward the toner discharging member 203. In the meantime, the toner drawing blade 209 rotates while sliding on the inner wall of the toner storage container 201 and deforming due to its flexibility to supply the toner to the toner discharging member 203. Then, the toner discharging member 203 leads the toner supplied from the toner drawing blades 209 to the toner supplying port 202 by its rotation.

The toner stirring member 208 and the toner discharging member 203 are configured to be rotated by the driving force from a gear transmission mechanism and a drive motor, not shown.

The toner drawing blades 209 are made of a PET (polyethylene terephthalate) sheet (flexible film) having a thickness of approximately 0.5 mm to 2 mm and attached to an end of the toner stirring member 208.

In FIG. 12, the developing device 400 comprises the developing tank 211, a stirring roller 213, a developing roller 212, a regulation member 214, and a toner concentration detection sensor 215. The developing tank 211 is an approximately semi-cylindrical container having an internal space, and it supports the stirring roller 213 and the developing roller 212 in a freely rotatable manner, and contains a two-component developer consisting of a toner and a carrier.

The stirring roller 213 is driven by a driving means, not shown, to rotate and stir the two-component developer contained in the developing tank 211.

The developing roller 212 conveys the two-component developer to the photosensitive drum 217, and it is a roller-shaped member that is driven by a driving means, not shown, to rotate. In addition, the developing roller 212 is provided so as to be opposed to the photosensitive drum 217 and rotate having a gap with respect to the photosensitive drum 217 as illustrated in FIG. 11.

The two-component developer conveyed by the developing roller 212 contacts with the photosensitive drum 217 at their nearest-neighbor part. This contact area is a developing nip part and, in the developing nip part, a development bias voltage is applied from a power source, not shown, connected to the developing roller 212 to the developing roller 212, and the toner is supplied from the developer on the surface of the developing roller 212 to the electrostatic latent image on the surface of the photosensitive drum 217.

The regulation member 214 is a plate-like member extending in parallel with a direction of an axis of the developing roller 212 and, vertically above the developing roller 212, it is provided so that one end thereof in the shorter direction is supported by the developing tank 211 and the other end has a gap with respect to the surface of the developing roller 212. As a material of the regulation member 214, aluminum, a synthetic resin, and the like may be used as well as stainless steel.

The toner concentration detection sensor 215 is mounted in a bottom face of the developing tank 211 and vertically under the stirring roller 213, and it is provided so that a sensor surface thereof exposes into the inside of the developing tank 211. The toner concentration detection sensor 215 is electrically connected to a control means, not shown. The control means provides control so that the toner discharging member 203 is driven to rotate according to a detection result from the toner concentration detection sensor 215 to supply the toner to the inside of the developing tank 211 via the toner supplying port 202.

When a detection result from the toner concentration detection sensor 215 is determined to be lower than a set value of the toner concentration, a control signal is sent to a driving means for rotationally driving the toner discharging member 203 to drive the toner discharging member 203 to rotate. As the toner concentration detection sensor 215, a general toner concentration detection sensor 215 may be used such as, for example, a transmitted light detection sensor, a reflected light detection sensor, and a magnetic permeability detection sensor. Among them, the magnetic permeability detection sensor is preferable.

A power source, not shown, is connected to the toner concentration detection sensor 215. The power source applies to the toner concentration detection sensor 215 a driving voltage for driving the toner concentration detection sensor 215 and a controlling voltage for outputting a detection result of the toner concentration to the control means. The application of the voltages to the toner concentration detection sensor 215 by the power source is carried out by the control means.

The toner concentration detection sensor 215 is a sensor of a system in which it outputs a detection result of the toner concentration as an output voltage value in response to the application of the controlling voltage, and it basically has higher sensitivity around the median of the output voltage. Therefore, the toner concentration detection sensor 215 is used with application of such a controlling voltage that an output voltage around the median can be obtained. Such a sensor has been marketed, and examples thereof include TS-L, TS-A, and TS-K (trade names, products by TDK Corporation).

As illustrated in FIG. 14, a shutter plate 318 is a rectangular aluminum conductive member that is slidably supported on the developing tank 211 while being biased in an arrow A direction by an elastic member (pull spring) 305 provided between the shutter plate 318 and an elastic member supporting part 305*a*. And, the shutter plate 318 is to open the toner supplying port 202 by sliding. Here, the shutter plate 318 is to be guided by a guide member, not shown, that is the same kind as the guide members 119*a*, 119*b* of Embodiment 1 (FIG. 6).

A copper plate electrode 201*a* is fixed as a conductive member in the vicinity of the toner supplying port 202 of the toner storage container 201. Before or immediately after the toner cartridge 210 is loaded in the image forming apparatus 230 as illustrated in FIG. 11, the shutter plate 318 is fixed by an electrically-releasing adhesive D in a position where the toner supplying port 202 is closed as illustrated in FIG. 14.

When the electrically-releasing adhesive is released by the action of electricity, the shutter plate 318 slides in the arrow A direction as illustrated in FIG. 15 by receiving the biasing force of the elastic member 305 whose one end is supported by the supporting part 305*a*, thereby opening the toner supplying port 202.

As will be described later, when an electric current is sent from a DC power source to a side of the shutter plate 318 as a first conductive member as an anode and a side of the copper plate electrode 201*a* as a second conductive member as a cathode, the electrically-releasing adhesive D undergoes bond-releasing selectively, that is, decreases in its adhesive strength only at an interface with the shutter plate 318, and the electrically-releasing adhesive D is therefore released from the interface while remaining stuck to the copper plate electrode 201*a*.

While the shutter plate 318 functions as the first conductive member in this embodiment, an electrode such as a copper plate may be fixed onto the surface of the shutter plate 318, and the fixed electrode may be used as the first conductive member. In this case, likewise, when an electric current is sent from the DC power source to the copper plate fixed on the shutter plate 318 as an anode and the copper plate electrode 201*a* as a cathode, the electrically-releasing adhesive D is released from the interface while remaining stuck to the copper plate electrode 201*a*.

Figure 9:
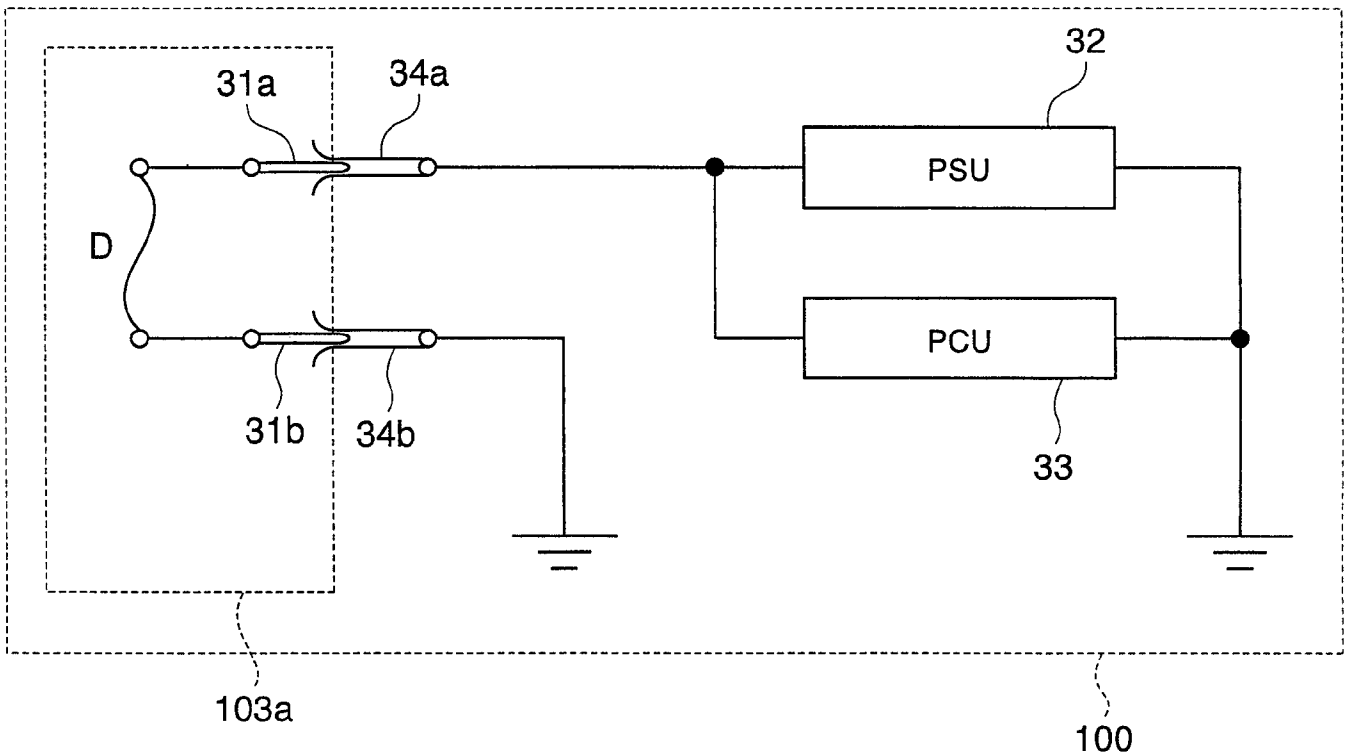
FIG. 9 is a circuit diagram of an electric circuit for initial detection of the image forming apparatus of the present invention.

FIG. 9 illustrates an example of an electric circuit for initial detection and opening of the shutter provided to each of the image forming apparatuses 100 and 230 in Embodiments 1 and 2. Here, the initial detection is to detect whether or not a mounted developing cartridge 103*a* or a mounted toner cartridge 210 is new.

A power source circuit (PSU) 32, a control circuit (PCU) 33, and contacts 34*a*, 34*b* that contact with connection terminals 31*a*, 31*b* of the developing cartridge 103*a* and the toner cartridge 210 are provided to each of the image forming apparatuses 100 and 230.

The control circuit 33 has a function of turning on the power source to detect conduction (resistance value) of the electrically-releasing adhesive D and distinguish whether or not the developing cartridge 103*a* or the toner cartridge 210 is new. The power source circuit (PSU) 32 has a function of sending an electric current to the electrically-releasing adhesive D to debond the electrically-releasing adhesive D.

When the developing cartridge 103*a* or the toner cartridge 210 is mounted in the image forming apparatus 100 or 230 in the above-described configuration, the connection terminals 31*a*, 31*b* at the cartridge side contact with and electrically connected to the contacts 34*a*, 34*b* at the image forming apparatus side. Here, in the developing cartridge 103*a*, the shutter plate 118 (FIG. 5) functions as the connection terminal 31*a*, and the stoppers 120*a*, 120*b* (FIG. 5) function as the connection terminal 31*b*. In the toner cartridge 210, in addition, the shutter plate 318 (FIG. 14) functions as the connection terminal 31*a*, and the copper plate electrode 201*a* (FIG. 14) functions as the connection terminal 31*b*.

When the power source of the control circuit 33 is turned on, an electric current is applied to the electrically-releasing adhesive D. Then, conduction (resistance value) of the electrically-releasing adhesive D is checked. When the developing cartridge 103*a* or the toner cartridge 210 is new, the electrically-releasing adhesive D is in close contact with the connection terminals 31*a*, 31*b*, and the resistance value detected by the control circuit 33 is therefore 1 kΩ or less. Then, the developing cartridge 103*a* or the toner cartridge 210 is judged to be new, and a maintenance counter in the control circuit 33 will be reset.

Thereafter, the power source of the power source circuit (PSU) 32 is turned on to apply a predetermined voltage to the electrically-releasing adhesive D and send an electric current to the electrically-releasing adhesive D, thereby releasing the electrically-releasing adhesive D. Here, the electric current is sent with a voltage and application time enough to cause a bond-releasing reaction to the electrically-releasing adhesive D.

In order to cause the bond-releasing reaction to the electrically-releasing adhesive D, approximately 3 to 10 A per square centimeter of the electric current is needed, and several V to several tens of V of the voltage is needed at the highest. In Embodiments 1 and 2, a voltage of 100 V is applied for one minute, and a direct current of approximately 3 A/cm$^2$ to 10 A/cm$^2$ is applied to the electrically-releasing adhesive D to cause the bond-releasing reaction to the interface with the electrically-releasing adhesive D and debond the electrically-releasing adhesive D.

When the electrically-releasing adhesive D is released, the shutter plate 118 or 318 slides as described above, and the connection terminal 31*a* and the connection terminal 31*b* are completely separated. Therefore, if the developing cartridge 103*a* or the toner cartridge 210 after having been removed from the image forming apparatus 100 or 230 is mounted again, the resistance value will be measured to be an infinite value, and it will be judged that the cartridge is not new.

Figure 10:
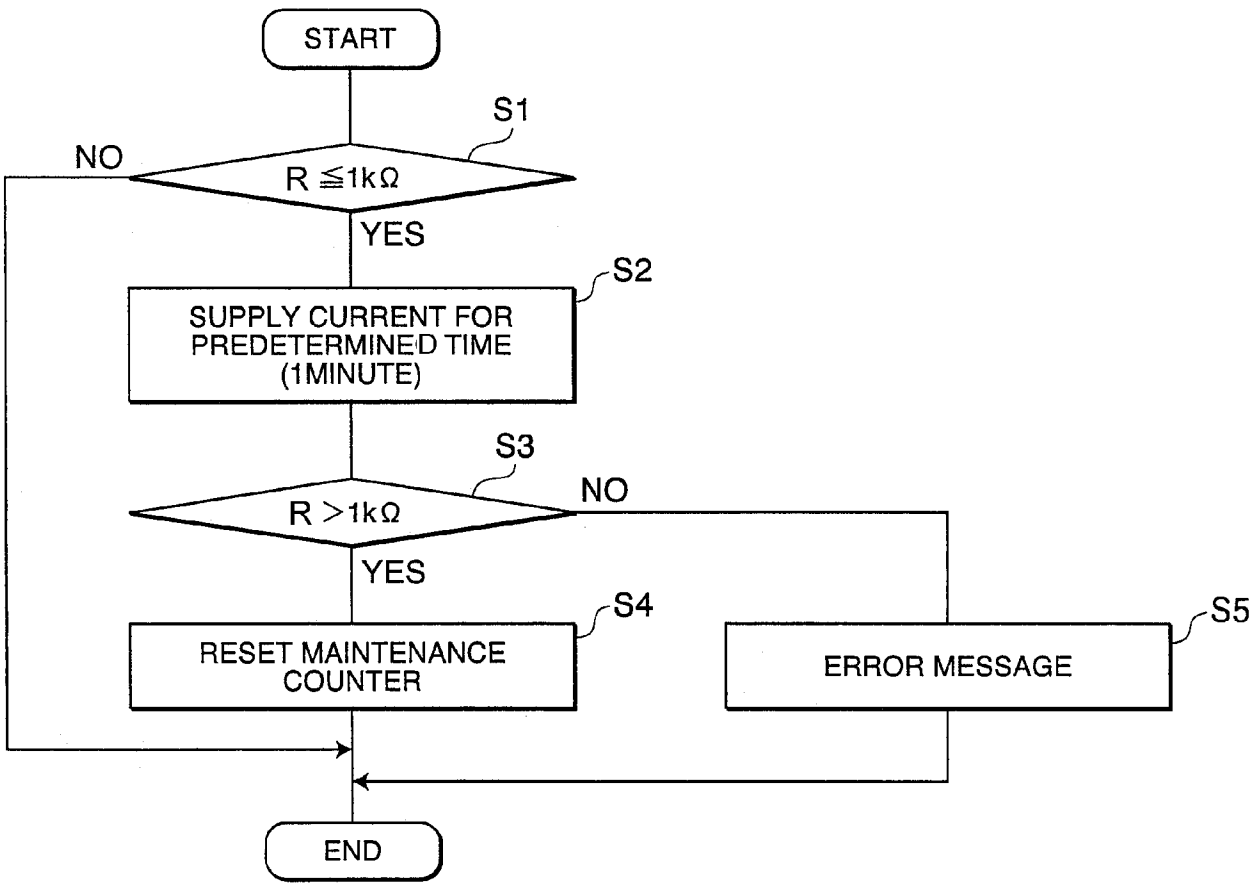
FIG. 10 is a flow chart of the initial detection in the image forming apparatus of the present invention.

FIG. 10 is a flow chart illustrating the method of the initial detection in the image forming apparatuses 100 and 230 in further detail.

In Step S1, when a new and unused developing cartridge 103*a* or toner cartridge 210 is mounted in the image forming apparatus 100 or 230, a predetermined voltage is applied from the control circuit (PCU) 33 to the connection terminals 31*a*, 31*b* via the contacts 34*a*, 34*b*, and the cartridge 103*a*, 210 is measured for the resistance value R. When the resistance value R is 1 kΩ or less, it is judged that the electrically-releasing adhesive D is bonding the connection terminals 31*a*, 31*b*. When the resistance value R is more than 1 kΩ, it is judged that the electrically-releasing adhesive D is not bonding, and the flow of the initial detection comes to an end.

In the case where it is judged that the electrically-releasing adhesive D is bonding the connection terminals 31*a*, 31*b*, a predetermined voltage is applied from the power source circuit (PSU) 32 in Step S2, for example, a voltage of 100 V is applied for one minute to apply an electric current to the electrically-releasing adhesive D. On this occasion, the electrically-releasing adhesive D is caused to have the bond-releasing reaction by a direct current applied between the connection terminals 31*a*, 31*b*, and the adhesive force thereof is decreased.

In Step S3, a predetermined voltage is applied from the control circuit (PCU) 33 to the connection terminals 31*a*, 31*b* via the contacts 34*a*, 34*b*, and the resistance value R is measured. When the resistance value R is more than 1 kΩ, it is judged that the electrically-releasing adhesive D is released, and the maintenance counter is reset in Step S4, and then the flow of the initial detection comes to an end. When the resistance value R is not more than 1 kΩ, it is judged to be insufficient bonding of the electrically-releasing adhesive D, and the control circuit 33 displays an error message on a display section, not shown, in Step S5, thereby notifying a user of the insufficient bonding of the electrically-releasing adhesive D.

What is claimed is:

1. A developing cartridge, comprising:

a developing roller for developing an electrostatic latent image on a photoconductor with a toner; and a developing tank for storing the toner to be supplied to the developing roller, the developing tank including:

a toner receiving port for receiving the toner to be stored;

a shutter having a function for sliding to open and close the toner receiving port, the shutter being adapted to be maintained in a closed state by an electrically-releasing adhesive; and a pair of conductive members for supplying an electric current to the electrically-releasing adhesive to open the shutter.

2. The developing cartridge as set forth in claim 1, wherein the developing tank comprises a toner supplying device connected to the toner receiving port.

3. The developing cartridge as set forth in claim 2, wherein the toner supplying device comprises a container for containing the toner and a conveyance means for conveying the toner from the container to the developing tank through the toner receiving port.

4. The developing cartridge as set forth in claim 1, further comprising a biasing member for applying a biasing force to the shutter in a direction for opening the shutter, wherein the electrically-releasing adhesive maintains the shutter in a closed state by resisting the biasing force.

5. The developing cartridge as set forth in claim 1, wherein the pair of conductive members includes a first conductive member and a second conductive member, the shutter has conductivity to be used as the first conductive member, the second conductive member is attached to the developing tank so as to be opposed to the first conductive member, and the electrically-releasing adhesive exists between the first and second conductive members to join the conductive members and maintain the shutter in a closed state when the shutter is closed.

6. An image forming apparatus using the developing cartridge as set forth in claim 1, the image forming apparatus comprising a power source for supplying the electric current to the electrically-releasing adhesive through the pair of conductive members.

7. The image forming apparatus as set forth in claim 6, further comprising a detection section for detecting an electrical resistance between the pair of conductive members.

8. The image forming apparatus as set forth in claim 7, further comprising a control circuit for judging based on the detected electrical resistance whether the developing cartridge is new.

9. The image forming apparatus as set forth in claim 7, further comprising a control circuit for judging based on the detected electrical resistance whether the shutter opens the toner receiving port.

10. The image forming apparatus as set forth in claim 7, further comprising a control circuit for judging based on the detected electrical resistance whether the electrically-releasing adhesive functions normally.

* * * * *